US008354211B2

(12) United States Patent
Kihara et al.

(10) Patent No.: US 8,354,211 B2
(45) Date of Patent: Jan. 15, 2013

(54) ELECTROPHOTOGRAPHIC PHOTORECEPTOR, IMAGE FORMING APPARATUS AND PROCESS CARTRIDGE

(75) Inventors: Akiko Kihara, Matsusaka (JP); Kotaro Fukushima, Kawanishi (JP); Takatsugu Obata, Nara (JP); Akihiro Kondoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 443 days.

(21) Appl. No.: 12/329,180

(22) Filed: Dec. 5, 2008

(65) Prior Publication Data

US 2009/0175650 A1 Jul. 9, 2009

(30) Foreign Application Priority Data

Dec. 6, 2007 (JP) ..... 2007-316059

(51) Int. Cl.
*G03G 21/18* (2006.01)

(52) U.S. Cl. ..... 430/58.8; 430/59.5

(58) Field of Classification Search ..... 430/58.8, 430/59.5

See application file for complete search history.

(56) References Cited

U.S. PATENT DOCUMENTS 4,346,158 A * 8/1982 Pai et al. ..... 430/58.8

(Continued)

FOREIGN PATENT DOCUMENTS

JP 63-155053 6/1988

(Continued)

OTHER PUBLICATIONS

Machine English language translation of JP2000056490 Feb. 2000.*

(Continued)

*Primary Examiner* — Hoa V Le

(74) *Attorney, Agent, or Firm* — Nixon & Vanderhye P.C.

(57) ABSTRACT

An electrophotographic photoreceptor comprising a layered-type photosensitive layer in which a charge generating layer containing a charge generating material and a charge transporting layer containing a charge transporting material are stacked, formed on a conductive supporting member made of a conductive material, wherein the electrophotographic photoreceptor has high sensitive characteristics to a semiconductor laser beam having a wavelength ranging from 380 to 500 nm; the charge transporting layer of the layered-type photosensitive layer contains as the charge transporting material, a triarylamine dimer compound represented by the general formula (1):

(1)

wherein $Ar_1$ and $Ar_2$ may be the same or different, and represent an unsubstituted or substituted arylene group or heterocyclic derivative bivalent group, $Ar_3$ and $Ar_4$ may be the same or different, and represent an unsubstituted or substituted aryl group or heterocyclic group, $R_1$ and $R_2$ may be the same or different, and represent an alkyl group, m and n represent an integer of 1 to 4, a and b may be the same of different, and represent a hydrogen atom, a halogen atom, or unsubstituted or substituted alkyl group, alkoxy group or amino group; and a film thickness of the photosensitive layer is 30 μm or less.

7 Claims, 6 Drawing Sheets

$^1$H-NMR spectrum chart of Exemplary compound No. 1

U.S. PATENT DOCUMENTS

| | | | | |
|---|---|---|---|---|
| 6,183,922 | B1 | 2/2001 | Takai et al. | |
| 2002/0045117 | A1* | 4/2002 | Shimada et al. | 430/66 |
| 2004/0049027 | A1* | 3/2004 | Hamasaki et al. | 540/135 |
| 2004/0058257 | A1* | 3/2004 | Azuma et al. | 430/56 |
| 2005/0260511 | A1 | 11/2005 | Kunieda et al. | |
| 2006/0292480 | A1 | 12/2006 | Niimi | |

FOREIGN PATENT DOCUMENTS

| | | | |
|---|---|---|---|
| JP | 5-19598 | | 1/1993 |
| JP | 06-130688 | | 5/1994 |
| JP | 10-239956 | | 9/1998 |
| JP | 2000-019752 | A | 1/2000 |
| JP | 2000056490 | * | 2/2000 |
| JP | 2000-089492 | A | 3/2000 |
| JP | 2000-105475 | | 4/2000 |
| JP | 2000-105478 | | 4/2000 |
| JP | 2000-105479 | A | 4/2000 |
| JP | 2001-060010 | A | 3/2001 |
| JP | 2002-40687 | | 2/2002 |
| JP | 2002-207302 | A | 7/2002 |
| JP | 2007-213039 | A | 8/2007 |
| JP | 2008275779 | * | 11/2008 |

OTHER PUBLICATIONS

Machine English language translation of JP 2008275779 Nov. 2008.*

JP Office Action mailed Sep. 29, 2009 in JP application 2007-316059.

JP Office Action mailed Apr. 6, 2010 in JP application 2007-316059.

* cited by examiner

Fig. 5 $^{1}$H-NMR spectrum chart of Exemplary compound No. 1

Normal $^{13}$C-NMR spectrum chart of Exemplary compound No. 1

DEPT 135 $^{13}$C-NMR spectrum chart of Exemplary compound No. 1

ELECTROPHOTOGRAPHIC PHOTORECEPTOR, IMAGE FORMING APPARATUS AND PROCESS CARTRIDGE

CROSS-REFERENCE TO RELATED APPLICATION

This application is related to Japanese Patent Application No. 2007-316059 filed on 6 Dec., 2007, whose priority is claimed under 35 USC §119, and the disclosure of which is incorporated by reference in its entirety.

BACKGROUND OF THE INVENTION

1. Field of the Invention

The present invention relates to an electrophotographic photoreceptor suitable for a semiconductor laser of a short wavelength capable of realizing a high resolution of an image, an image forming apparatus, and a process cartridge attachable/detachable to/from an electrophotographic apparatus main body.

2. Description of the Related Art

In recent years, organic photoconductive materials have been widely used more frequently in electrophotographic photoreceptors generally by virtue of their advanced development, compared to inorganic photoconductive materials that have been conventionally used. This is because electrophotographic photoreceptors using an organic photoconductive material have many advantages in terms of toxicity, cost, flexibility in material design and the like, over the inorganic photoconductive materials although it has some problems in terms of sensitivity, durability and environmental stability.

As structures of electrophotographic photoreceptors having been put into practical use at present, there are proposed layered-type or distributive-type function separated type photoreceptors in which a charge (electron, positive hole) generating function by a photoconductive material, and a charge transporting function for transporting the generated charge by electric field applied on the electrophotographic photoreceptor are respectively assigned to separate substances.

Such a function separated type photoreceptor accepts a wide range of substances for respective functions, and hence is able to provide a photoreceptor realizing high performance in electrophotographic characteristics such as charge characteristics, sensitivity, a residual potential, repeating characteristics, printing resistance and so on, by combining best substances.

Furthermore, since it can be produced by applying a photosensitive layer on a conductive supporting member, it is possible to provide a photoreceptor with very high productivity and a low cost, and to freely control a photosensitive wavelength region and photosensitivity by selecting an appropriate charge generating material.

Furthermore, owing to improvement in performance of electrophotographic photoreceptors using an organic photoconductive material to overcome conventional problematic points in characteristics, for example, ability of designing a photoreceptor having excellent abrasion resistance by appropriately selecting a binder resin to be contained in the charge transporting layer, organic photoconductive materials have been used more often as compared to inorganic photoconductive materials.

As an electrophotographic apparatus using a laser beam as an optical source of light exposure, a laser printer can be recited as a representative example, however, recent advanced digitalization has made common to use a laser beam as an optical source of light exposure in copying machines.

As a laser beam mainly used as an optical source for light exposure, a semiconductor laser which is low in cost, small in consumed energy, light in weight and small in size has been brought into practical use, and a typical laser has an emission wavelength in a near-infrared region around 800 nm from the viewpoints of stability in an emission wavelength and output and life time.

This is because a laser beam having an emission wavelength in a short wavelength region has not been put into practical use due to technical problems. In light of this, as a charge generating material used in an electrophotographic apparatus using a laser beam as an optical source for light exposure, a layered-type photoreceptor in which an organic compound having light absorption and light sensitivity in a long wavelength region, in particular, phthalocyanine pigment is contained in a charge generating material has been developed.

On the other hand, in order to improve image quality of output image of an electrophotographic apparatus, consideration is made to increase the resolution of the image. Some measures are conceivable to achieve images of a high recording density and a high resolution, and as an optical measure, it can be recited to increase the writing density by narrowing down the spot diameter of the laser beam.

For achieving this, a focal distance of the using lens may be shortened, however, it was found that in addition to the difficulty in designing an optical system, in the laser having an emission wavelength in a near-infrared region of around 800 nm, sharpness of spot contour is difficult to be obtained even when the beam diameter is narrowed down by operation of the optical system. This is attributable to a diffraction limit of a laser beam, which is inevitable phenomenon.

However, when a spot diameter of a laser converged on a surface of a photoreceptor is taken as D, the relation represented by:

$$D=1.22\lambda/NA$$

($\lambda$ represents a wavelength of a laser beam, and NA represents the number of lens apertures) is satisfied.

From this formula, it can be found that since spot diameter D is in a proportion to an emission wavelength of a laser beam, a laser with a shorter emission wavelength may be used to decrease the spot diameter D. Also, Japanese Patent Application Laid-Open Publication No. 5-19598 proposes an electrophotographic apparatus using a short wavelength laser.

In view of the above, it is recently conceived to use a blue (violet) semiconductor laser of a short wavelength that is getting into practical use for DVD, as a light exposure optical source (writing optical source) of an electrophotographic apparatus. When a blue (violet) semiconductor laser beam (380 to 500 nm) having about one third to half of an emission wavelength compared to a conventional semiconductor laser beam in a near-infrared region is used as a light exposure optical source, it is possible to make the beam spot diameter very small while keeping the sharpness of the contour as shown by the above formula. Therefore, it provides a very effective measure for realizing super-fine image quality.

By using a blue (violet) semiconductor laser beam as an optical source for light exposure in the manner as described above, it is possible to irradiate the electrophotographic photoreceptor with a beam spot diameter of about 40 μm or less while keeping the sharpness of the contour.

Hence, in an electrophotographic apparatus in which a blue (violet) semiconductor laser beam is used as an optical source and a beam spot diameter is reduced, an electrophotographic photoreceptor having a certain degree or higher sensitivity to light irradiation of an image light exposure apparatus is naturally needed.

Further, in order to use the light emitted to the electrophotographic photoreceptor effectively, it is requested to have high spectral sensitivity in the wavelength region of the optical source. Further, to utilize the small beam spot diameter more efficiently, a higher resolution is realized by reducing the film thickness of the charge transporting layer.

However, the number of electrophotographic photoreceptors having high spectral sensitivity in the wavelength region of the optical source is very small. A variety of researches are now underwent, taking note of organic photoreceptors having various advantages including excellent environmental compatibility, easiness of production and handling, and low cost.

For example, as for azo pigments intended for a blue (violet) semiconductor laser, Japanese Patent Application Laid-Open Publication No. 10-239956 discloses an exemplary embodiment using an anthraquinone-based azo pigment, and Japanese Patent Application Laid-Open Publication No. 2000-105478 discloses an exemplary embodiment using an azo pigment having various couplers.

However, in any of these cases, sufficient sensitivity is not achieved for a blue (violet) semiconductor laser.

Further, in order to improve the image quality level by using a blue (violet) semiconductor laser as an optical source and reducing a beam spot diameter, it is generally requested to reduce a film thickness of the photosensitive layer. However, it is also requested to improve mechanical printing resistance for reducing the film thickness of the photosensitive layer while keeping conventional life time. For achieving this, the measure of increasing the content of binder resin and the like is taken. However, when the content of binder resin increases in comparison with the charge transporting material, the problem arises that the electric characteristics such as sensitivity and light response deteriorate.

SUMMARY OF THE INVENTION

It is an object of the present invention to provide an electrophotographic photoreceptor having high sensitivity characteristics in a wavelength region of 380 to 500 nm, and capable of outputting an image with super high image quality with stable electric characteristics and mechanical resistance, and an image forming apparatus or a process cartridge having the same.

The inventors of the present invention made diligent efforts, and as a result, they found that a photoreceptor in which a triarylamine dimer compound having a specific substituent mode is contained as a charge transporting material has very high spectral sensitivity to a blue (violet) semiconductor laser optical source, and is able to output an image with high sensitivity, a high charge potential and a high resolution.

Therefore, according to the present invention, the mechanical resistance is further improved, and a film thickness of the charge transporting layer can be reduced without increasing content of the binder resin at sacrifice of the electric characteristics as is the case where an usual charge transporting material is used. In this way, it is possible to utilize the blue (violet) semiconductor laser optical source having a small beam spot diameter of a laser beam more effectively, and thus it becomes possible to output an image with a high resolution.

To be more specific, according to the present invention, there is provided an electrophotographic photoreceptor containing a layered-type photosensitive layer in which a charge generating layer containing a charge generating material and a charge transporting layer containing a charge transporting material are stacked, formed on a conductive supporting member made of a conductive material, wherein the electrophotographic photoreceptor has high sensitive characteristics to a semiconductor laser beam having a wavelength ranging from 380 to 500 nm; the charge transporting layer of the layered-type photosensitive layer contains as the charge transporting material, a triarylamine dimer compound represented by the general formula (1):

(1)

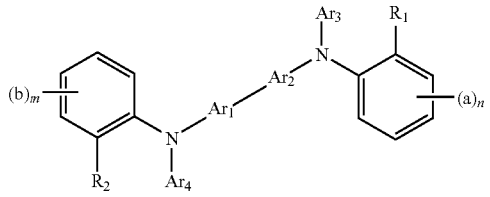

wherein $Ar_1$ and $Ar_2$ may be the same or different, and represent an unsubstituted or substituted arylene group or an unsubstituted or substituted heterocyclic derivative bivalent group, $Ar_3$ and $Ar_4$ may be the same or different, and represent an unsubstituted or substituted aryl group or an unsubstituted or substituted heterocyclic group, $R_1$ and $R_2$ may be the same or different, and represent an alkyl group, m and n represent an integer of 1 to 4, a and b may be the same of different, and represent a hydrogen atom, a halogen atom, an alkyl group, a fluoroalkyl group, an alkoxy group or an unsubstituted or substituted amino group, and when the m or n is 2 or more, and two of a or b are adjacent to each other, a methylenedioxy group, an ethylenedioxy group, a tetramethylene group or a butadienylene group is formed; and a film thickness of the photosensitive layer is 30 μm or less (hereinafter, also referred to "photoreceptor").

Further, according to the present invention, there is provided an image forming apparatus containing the above photoreceptor, a charging means that charges the photoreceptor, a light-exposing means that exposes the charged photoreceptor to light, and a developing means that develops an electrostatic latent image formed by the light exposure.

Also, according to the present invention, there is provided an image forming apparatus comprising the electrophotographic photoreceptor, a charging means, a light-exposing means including a semiconductor laser beam having a wavelength ranging from 380 to 500 nm, a developing means, and a transferring means.

Further, according to the present invention, there is provided a process cartridge supporting at least one means selected from the group consisting of an electrophotographic photoreceptor, a charging means, a developing means and a cleaning means in an integrated manner, the process cartridge being attachable/detachable to/from a main body of an electrophotographic apparatus.

Further, according to the present invention, there is provided a triarylamine dimer compound represented by structural formula (1):

(I)

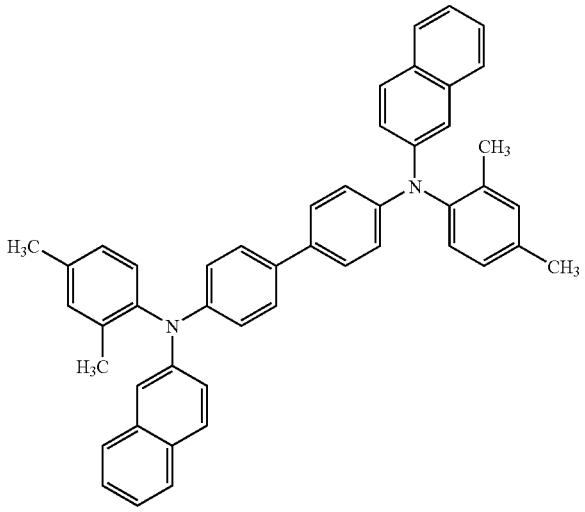

According to the present invention, by using a triarylamine dimer compound represented by the general formula (1) having an o-methyl-phenyl substituent in the photosensitive layer, and it is possible to reduce a film thickness of a charge transporting layer b without increasing a content of a binder resin at sacrifice of the electric characteristics as is the case where a usual charge transporting material is used because excellent electric characteristics with respect to the blue (violet) semiconductor laser is obtained, and high printing resistance are provided. Hence, it is possible to provide a process cartridge and an electrophotographic apparatus capable of obtaining an output image with a high resolution over a long term.

DETAILED DESCRIPTION OF THE INVENTION

In the following, the present invention will be explained more specifically with reference to attached drawings.

Figure 1:
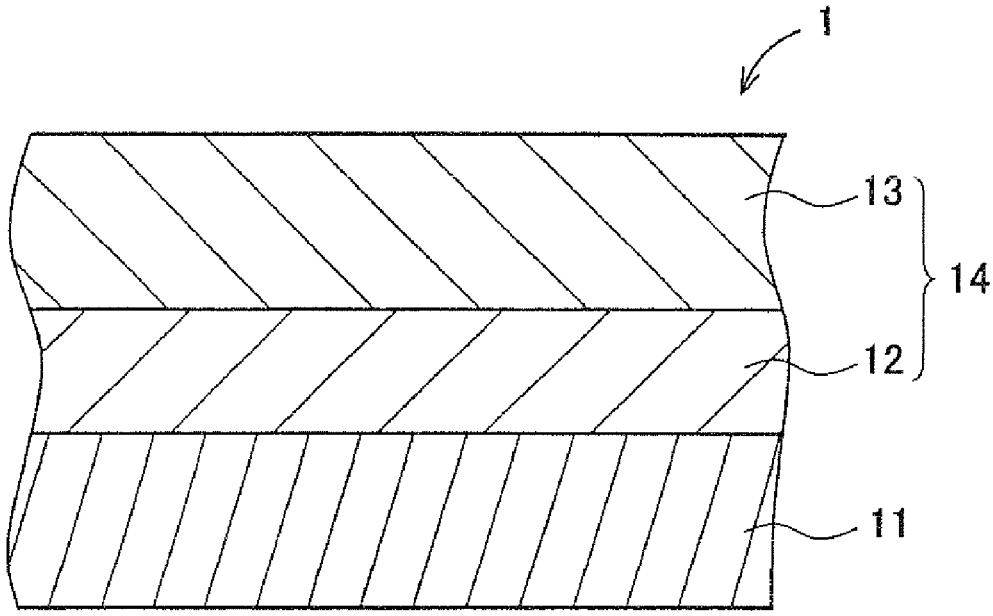
FIG. 1 is one example of a layered-type electrophotographic photoreceptor according to an embodiment of the present invention.
Figure 2:
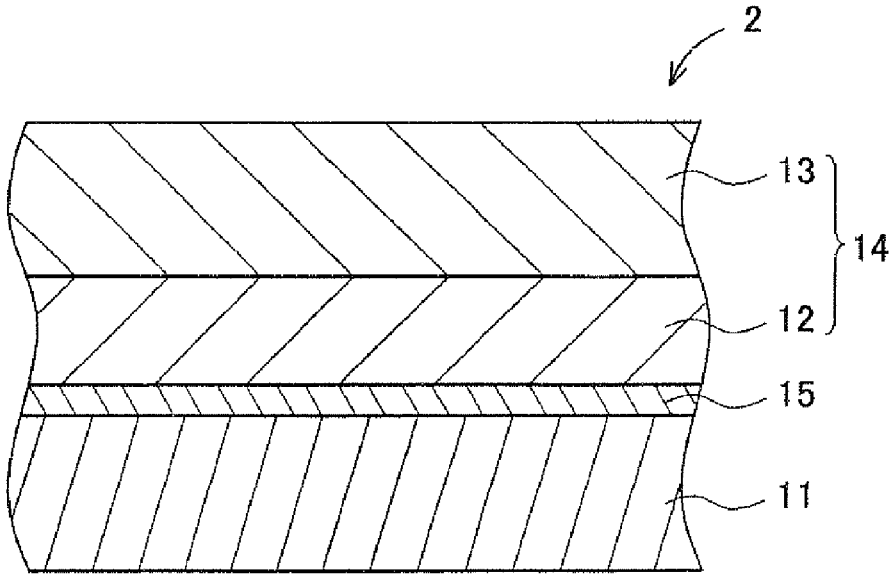
FIG. 2 is another example of a layered-type electrophotographic photoreceptor according to an embodiment of the present invention.

FIG. 1 and FIG. 2 show a photoreceptor which is one exemplary embodiment of the present invention. In these drawings, the reference numeral 11 denotes a conductive supporting member, 12 denotes a charge generating layer, 13 denotes a charge transporting layer, 14 denotes a photosensitive layer, and 15 denotes an undercoat layer (also referred to as an "intermediate layer").

That is, the photoreceptor shown in FIG. 1 and FIG. 2 is a function separated type layered photoreceptor.

Conductive Supporting Member

As a conductive supporting member that may be used, metal materials such as aluminum, stainless steel, copper and nickel, or polyester films, phenol resin pipes, paper tubes, and the like insulating substances formed on their surface with a conductive layer of aluminum, copper, palladium, tin oxide, indium oxide or the like can be recited. The form of a conductive supporting member 1 may be any of a sheet form, a drum form and a seamless belt form.

Undercoat Layer

In the undercoat layer 15 may be formed on the conductive supporting member 11, polyvinyl alcohol, casein, polyvinylpyrrolidone, polacrylic acid, celluloses, gelatin, starch, polyurethane, polyimide, polyamide and the like organic polymeric compounds are used. Among these, polyamide resin which is soluble in organic solvent is particularly preferred because solving and swelling will not occur with respect to a solvent used in forming a photoreceptor layer on the undercoat layer, and it is excellent in adhesion with the conductive supporting member.

As an appropriate solvent used in a dispersion for undercoat layer formation in which the above polymeric compound is dispersed, alcohol selected from the group consisting of lower alcohols having 1 to 4 carbon atoms and mixture thereof, dichloromethane, chloroform, 1,2-dichloroethane, 1,2-dichloropropane, toluene, tetrahydrofuran (THF), 1,3-dioxolane or mixture thereof can be recited.

The undercoat layer 15 is obtained by dissolving the above organic polymeric compound in the solvent selected from the group consisting of the above solvents and mixtures thereof, and applying it on a surface of the conductive base by a dip coater or the like. In particular, from the viewpoint of environmental protection, a non-halogen-based solvent is preferably used.

In the above dispersion for undercoat layer formation, zinc oxide, titanium oxide, tin oxide, indium oxide, silica, antinomy oxide and the like inorganic pigment may be dispersed and contained by using a dispersing machine such as a ball mill, a DYNO mill, an ultrasonic oscillator, and the like as is necessary, particularly for the purpose of setting a volume resistance of the undercoat layer and improvement in repeat aging characteristics in low temperature/low humidity environment, and the like.

A proportion of the inorganic pigment in the undercoat layer is preferably 30 to 95% by weight, relative to the total amount of the dispersion for undercoat layer formation, and application is made so that the film thickness is about 0.1 to 5 μm.

Charge Generating Layer

The charge generating layer 12 is mainly composed of a charge generating material and a binder resin.

As the charge generating material, a substance that generates charge with light having a wavelength ranging from 380 to 500 nm is desired. Concrete examples of such a charge generating material include, but are not limited to, azo compounds such as a bis azo compound and a tris azo compound, a squarylium compound, an azlenium compound, a perylenic compound, an indigo compound, a quinacridone compound, a polycyclic quinine compound, a cyanine pigment, a xanthene dye, oxotitanium phthalocyanine, and charge transfer complexes made up of poly-N-vinylcarbazole and trinitrofluolene, and the like. These charge generating materials may be used in combination of two or more kinds as is necessary.

Among these, using oxotitanium phthalocyanine in which a Bragg angle (2θ±0.2°) in Cu—Kα characteristic X-ray diffraction (wavelength: 1.54 Å) has a diffraction peak at least at 27.2° as a charge generating material in the charge generating layer is particularly preferred, because stable electrophotographic photoreceptor sensitivity is obtained.

As the binder resin used in the charge generating layer 12, for example, polyester resin, polyvinyl acetate, polyacrylic acid ester, polycarbonate, polyvinyl acetacetal, polyvinyl propional, polyvinylbutyral, phenoxy resin, epoxy resin, urethane resin, cellulose ester, cellulose ether and the like can be exemplified.

As an appropriate solvent for dispersing the charge generating material, halogenated hydrocarbons such as dichloromethane and 1,2-dichloromethane, ketones such as acetone, methylethylketone and cyclohexanone, esters such as ethyl acetate and butyl acetate, ethers such as tetrahydrofuran and dioxane, aromatic hydrocarbons such as benzene, toluene and xylene, aprotic polar solvents such as N,N-dimethylformamide and dimethylsulfoxide and the like can be used. In particular, non-halogenic solvents are preferably used from the viewpoint of environmental protection.

As a method of forming the charge generating layer 12, generally used are vacuum deposition, sputtering, CVD and the like vapor phase deposition, or grinding a charge generating material by a ball mill, a sand grinder, a paint shaker, an ultrasonic disperser or the like, dispersing it in a solvent, and adding a binder resin as necessary, or a baker applicator, a bar coater, casting, spin coating and the like method when the conductive supporting member 1 is a sheet.

Furthermore, when the conductive supporting member 1 is a drum, forming methods by a spraying method, a vertical ring method, dip coating, and the like are known. Proportion of the charge generating material in the charge generating layer is preferably in the range of 30 to 90% by weight. A film thickness of the charge generating layer is preferably from 0.05 to 5 μm, and more preferably from 0.1 to 2.5 μm.

Charge Transporting Layer

The charge transporting layer 13 is mainly formed of a charge transporting material and a binder resin.

As the charge transporting material, examples thereof include triarylamine dimer compounds represented by the general formula (1) shown in the table below.

TABLE 1

(1)

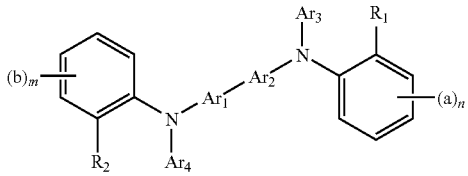

| Exemplary compound No. | $Ar_1$ | $Ar_2$ | $Ar_3$ | $Ar_4$ | 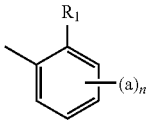 | 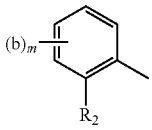 |
|---|---|---|---|---|---|---|
| 1 | 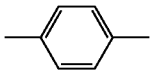 | 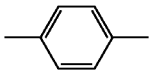 | 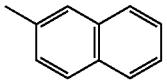 | 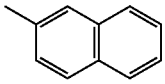 | 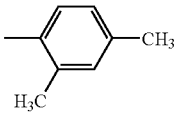 | 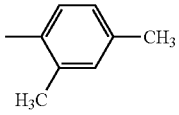 |
| 2 | 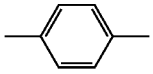 | 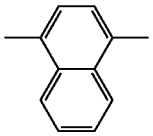 | 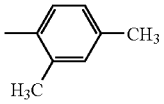 | 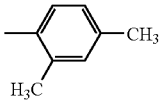 | 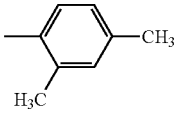 | 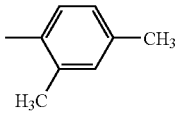 |
| 3 | 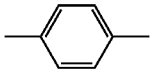 | 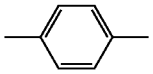 | 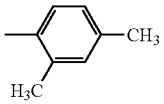 | 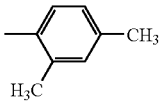 | 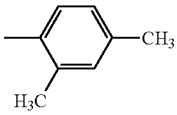 | 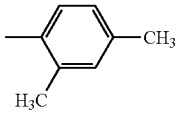 |
| 4 | 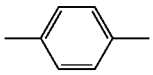 | 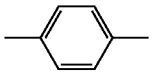 | 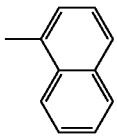 | 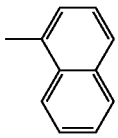 | 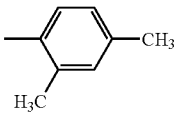 | 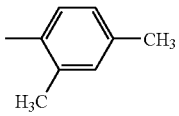 |
| 5 | 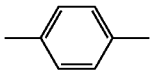 | 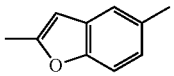 | 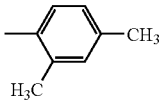 | 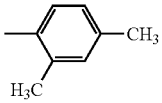 | 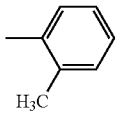 | 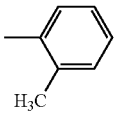 |
| 6 | 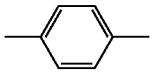 | 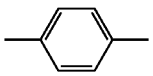 | 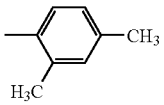 | 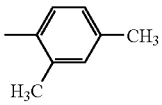 | 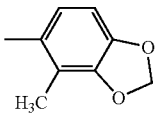 | 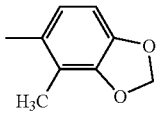 |
| 7 | 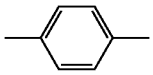 | 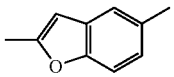 | 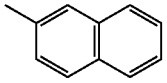 | 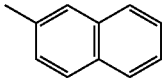 | 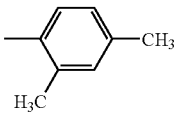 | 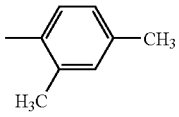 |

TABLE 1-continued
(1)
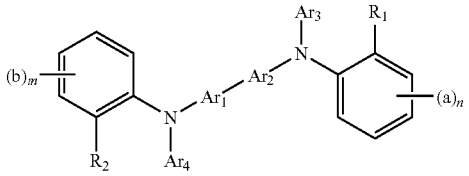
| Exemplary compound No. | $Ar_1$ | $Ar_2$ | $Ar_3$ | $Ar_4$ | 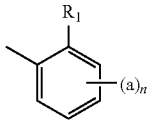 | 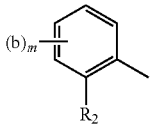 |
|---|---|---|---|---|---|---|
| 8 | 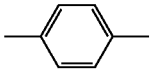 | 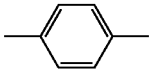 | 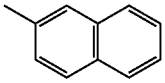 | 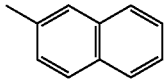 | 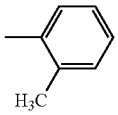 | 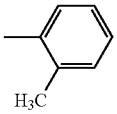 |
| 9 | 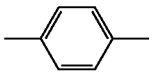 | 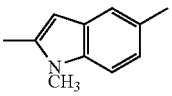 | 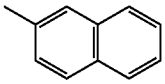 | 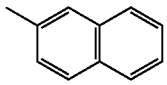 | 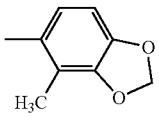 | 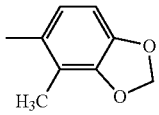 |
| 10 | 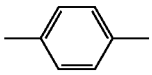 | 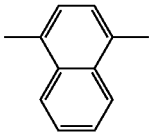 | 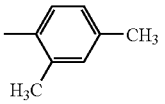 | 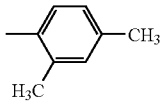 | 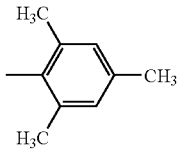 | 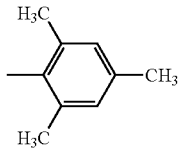 |
| 11 | 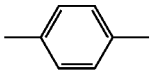 | 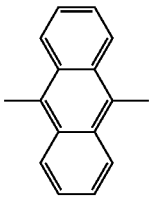 | 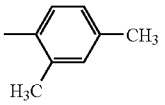 | 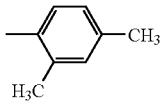 | 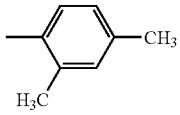 | 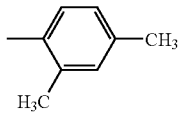 |
| 12 | 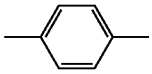 | 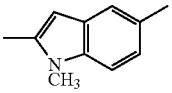 | 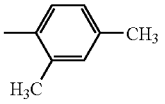 | 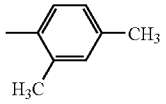 | 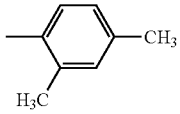 | 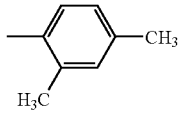 |
| 13 | 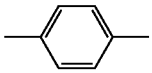 | 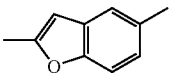 | 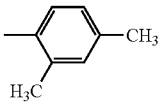 | 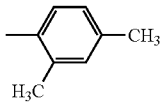 | 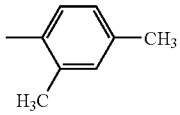 | 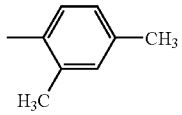 |
| 14 | 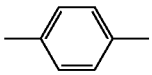 | 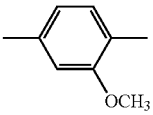 | 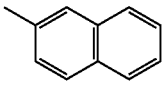 | 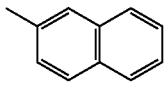 | 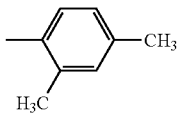 | 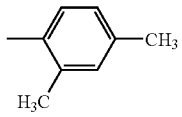 |
| 15 | 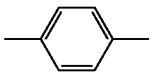 | 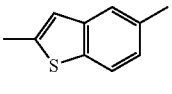 | 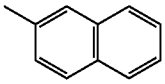 | 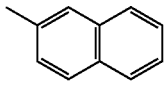 | 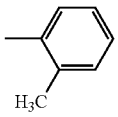 | 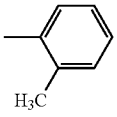 |

TABLE 1-continued (1)

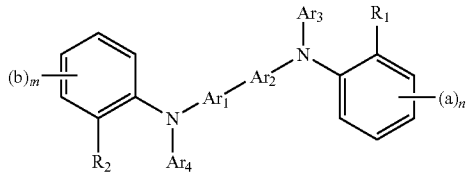

| Exemplary compound No. | $Ar_1$ | $Ar_2$ | $Ar_3$ | $Ar_4$ | 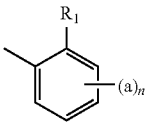 | 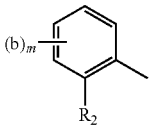 |
|---|---|---|---|---|---|---|
| 16 | 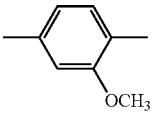 | 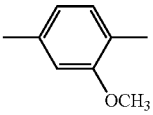 | 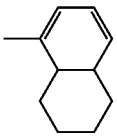 | 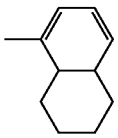 | 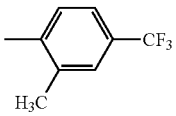 | 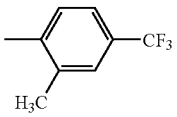 |
| 17 | 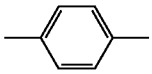 | 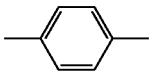 | 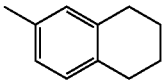 | 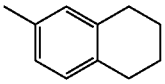 | 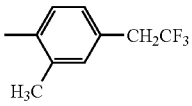 | 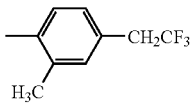 |
| 18 | 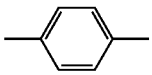 | 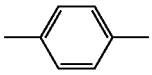 | 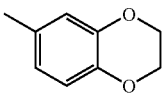 | 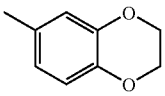 | 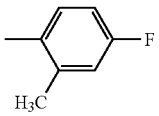 | 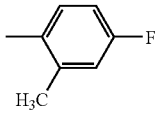 |
| 19 | 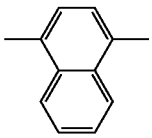 | 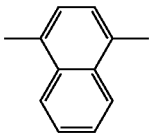 | 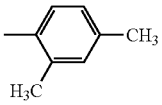 | 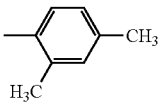 | 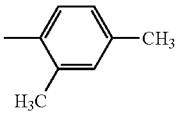 | 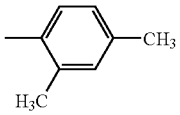 |
| 20 | 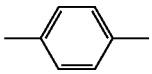 | 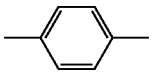 | 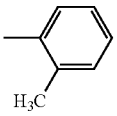 | 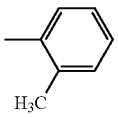 | 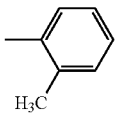 | 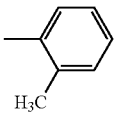 |

As the binder resin used in the charge transporting layer 13, for example, vinyl polymers such as polymethyl methacrylate, polystyrene and polyvinyl chloride, and copolymers thereof, polycarbonates, polyarylate, polyester, polyester carbonate, polysulfone, polyimide, phenoxy, epoxy, silicone resins and bisphenol Z-type polycarbonate resin (Type TS2040: available from TEIJIN CHEMICALS LTD.), and the like can be recited. Partially cross-linked hardened products of the above resins may be used. Furthermore, the above resins may be used singly or in mixture of two or more kinds. Among these, bisphenol Z-type polycarbonate is preferred from the viewpoint of film formability and abrasion resistance.

In the electrophotographic photosensitive layer of the present invention, as to a preferred ratio between the charge transporting material and the binder resin, a ratio M/B between a weight M of the charge transporting material and a weight B of the binder resin is 10/8 to 10/30, and preferably 10/15 to 10/20.

When the ratio M/B is less than 10/30 and the proportion of the binder resin is high, viscosity of an a coating solution increases in forming the charge transporting layer by dip coating, leading decrease in a coating speed. This may result in significant reduction in productivity.

When an amount of a solvent in the coating solution is increased to prevent the viscosity of the coating solution from increasing, blushing phenomenon occurs, and clouding may occur in the formed charge transporting layer.

On the other hand, when the ratio M/B exceeds 10/8 and the proportion of the binder resin 17 is low, printing resistance is lowered compared to the case where the proportion of the binder resin is high, and an abrasion amount of the photosensitive layer may increase.

An appropriate solvent for dissolving (dispersing) the charge transporting material is not substantially different from the solvent for dispersing the charge generating material and may be selected and used from the solvents recited above.

The coating solution for charge transporting layer formation used in the present invention may be added with vitamin E, hydroquinone, hindered amine, hindered phenol, paraphenyldiamine, aryl alkane and derivatives thereof, organic sulfur compounds, organic phosphorus, compounds or the like as an antioxidant.

As a formation method of the charge transporting layer 13, a Baker applicator, a bar coater, casting, spin coating or the like is used when the conductive supporting member 1 is a sheet. When the conductive supporting member 1 is a drum, a spray method, a vertical ring method, dip coating or the like is used. In particular, from the viewpoint of productivity and cost, dip coating or the like is generally preferred. A film thickness of the charge transporting layer is 10 to 50 μm, and preferably 15 to 40 μm.

Image Forming Apparatus

The image forming apparatus of the present invention is featured by having the photoreceptor of the present invention, a charging means that charges the photoreceptor, a light-exposing means that conducts light exposure on the charged photoreceptor, and a developing means that develops an electrostatic latent image formed by the light exposure.

An image forming apparatus of the present invention will be described with reference to the drawings, however, the following description is not given in a limitative manner.

Figure 3A:
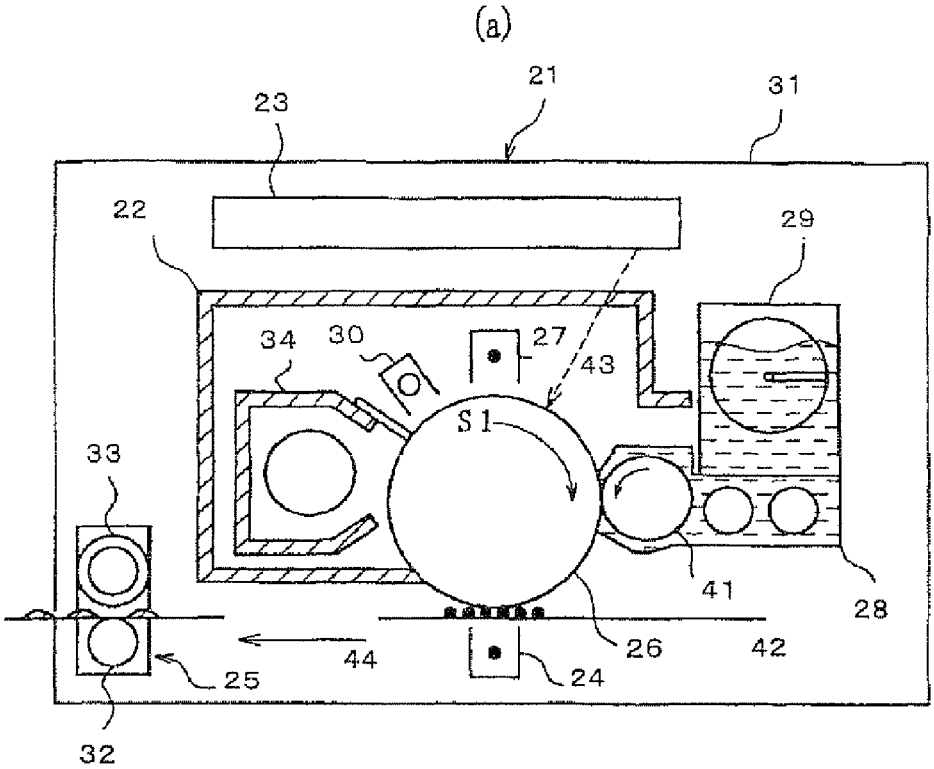
FIG. 3A is a schematic view of an image forming apparatus according to an embodiment of the present invention.

FIG. 3A is a schematic side view showing a structure of an image forming apparatus of the present invention.

An image forming apparatus 21 shown in FIG. 3A includes a photoreceptor drum 26 formed by the photoreceptor 1 or 2 (for example, FIG. 1 or 2) of the present invention, a charging means (charging unit) 27, a light-exposing means 23, a developing means (developing unit) 28, a transferring unit (transferring charger) 24, a cleaner 34, and a fixing unit 25. A reference numeral 42 denotes transfer paper. The photoreceptor 1 is cylindrical, and is supported by a main body of an image forming apparatus 31 (not shown) as the rotatable photoreceptor drum 26, and is driven to rotate in the direction of an arrow S1 by a driving means (not shown). The driving means includes, for example, an electric motor and a reducing gear, and makes the photoreceptor drum 26 rotate at a predetermined circumferential speed by transmitting its driving force to a conductive supporting member forming a core member of the photoreceptor drum 26. The charging unit 27, the light-exposing means 23, the developing unit 28, the transferring unit 24 and the cleaner 34 are provided in this order along the outer circumferential face of the photoreceptor drum 26 from the upstream side toward the downstream side in the rotation direction of the photoreceptor drum 26 shown by the arrow S1. Also, the fixing unit 25 is provided in an advancing direction of the transfer paper 42.

The charging unit 27 is a charging means that charges outer circumferential face of the photoreceptor drum 26 at a predetermined positive or negative potential.

As the charging means, a non-contact type charger wire may be used, however, in use of a charging roller for which high abrasion resistance of the photoreceptor surface is required, the photoreceptor formed with the charge transporting layer according to the present invention exerts a greater effect on improvement in durability.

Therefore, in the image forming apparatus of the present invention, the charging means may be utilized both in non-contact type charging and in contact type charging.

The light-exposing means 23 has, for example, a semiconductor laser beam as an optical source, and conducts light exposure according to image information on the charged outer circumferential face of the photoreceptor drum 26 by irradiating between the charging unit 27 and the developing unit 28 of the photoreceptor drum 26 with light 43 such as a laser beam outputted from the optical source. The light 43 is scanned repeatedly in the direction of extension of the rotation axis of the photoreceptor drum 26 which is the main scanning direction (longitudinal direction), and in association with this, an electrostatic latent image is sequentially formed on a surface of the photoreceptor drum 26.

The developing unit 28 is a developing means that develops an electrostatic latent image formed on outer circumferential face of the photoreceptor drum 26 as a result of light exposure, with a developing agent, and is disposed to face with the photoreceptor drum 26. The developing unit 28 includes a developing roller 41 for supplying toner to the outer circumferential face of the photoreceptor drum 26, and a casing (developing unit) 28 that supports the developing roller 41 so as to be rotatable about the rotation axis that is parallel with the rotation axis of the photoreceptor drum 26 and accommodates a developing agent containing toner in its inner space.

The transferring unit 24 is a transferring means that transfers a toner image which is a visible image formed on outer circumferential face of the photoreceptor drum 26 by development, onto the transfer paper 42 which is a recording medium supplied between the photoreceptor drum 26 and the transferring unit 24, discharged in the direction of an arrow 44 by a conveying means (not shown) in synchronization with light exposure to the photoreceptor 1. That is, the transferring unit 24 is, for example, a non-contact type transferring means that has a charging means, and transfers a toner image onto the transfer paper 42 by giving charge of opposite polarity to that of the toner, to the transfer paper 42.

The cleaner 34 is a cleaning means that removes and collects toner remaining on the outer circumferential face of the photoreceptor drum 26 after transferring operation by the transferring unit 24, and includes a cleaning blade (not shown) for peeling off the toner remaining on the outer circumferential face of the photoreceptor drum 26, and a collecting casing for accommodating the toner peeled off by the cleaning blade. The cleaner 34 is provided together with the an electricity removing lamp (not shown).

The image forming apparatus 21 is further provided with the fixing unit 25 which is a fixing means for fixing a transferred image, on the downstream side of conveyance of the transfer paper 42 having passed between the photoreceptor drum 26 and the transferring unit 24. The fixing unit 25 includes a heating roller 33 having a heating means (not shown), and a pressurizing roller 32 which is disposed to be opposite to the heating roller 33 to form an abutting part by being pressed by the heating roller 33.

An image forming operation by the image forming apparatus 21 is conducted in the following manner. First, as the photoreceptor drum 26 is driven to rotate in the direction of the arrow S1, a surface of the photoreceptor drum 26 is uniformly charged at a predetermined positive or negative potential by the charging unit 27 disposed on the upstream side of the rotation direction of the photoreceptor drum 26, than the imaging point of the light 43 by the light-exposing means 23.

Subsequently, from the light-exposing means 23, the light 43 corresponding to image information is emitted onto a surface of the photoreceptor drum 26. Surface charge in the part irradiated with the light 43 of the photoreceptor drum 26 is removed by this light exposure, and a difference arises between a surface potential of the part irradiated with the light 43, and a surface potential of the part not irradiated with the light 43, so that an electrostatic latent image is formed.

From the developing unit 28 disposed on a downstream side of the rotation direction of the photoreceptor drum 26 than the imaging point of the light 43 by the light-exposing means 23, toner is supplied to a surface of the photoreceptor drum 26 where the electrostatic latent image is formed, and the electrostatic latent image is developed, and thus a toner image is formed.

In synchronization with light exposure to the photoreceptor drum 26, the transfer paper 42 is supplied between the photoreceptor drum 26 and the transferring unit 24. By the transferring unit 24, charge of the polarity opposite to that of toner is given to the supplied transfer paper 42, and the toner image formed on a surface of the photoreceptor drum 26 is transferred onto the transfer paper 42.

The transfer paper 42 onto which the toner image is transferred is discharged in the direction of the arrow 44 and conveyed to the fixing unit 25 by a conveying means, and heated and pressurized as it passes the abutting part between the heating roller 33 and the pressurizing roller 32 of the fixing unit 25, so that toner image is fixed onto the transfer paper 42 to form a solid image. The transfer paper 42 on which the image is formed in this manner is then discharged outside the image forming apparatus 21 by a conveying means.

On the other hand, toner that remains on a surface of the photoreceptor drum 26 even after transferring of toner image by the transferring unit 24 is peeled off the surface of the photoreceptor drum 26 and collected by the cleaner 34. Charge of the surface of the photoreceptor drum 26 from which the toner is removed in the above manner is then removed by light from the electricity removing lamp, so that the electrostatic latent image on the surface of the photoreceptor drum 26 disappears. Thereafter, the photoreceptor drum 26 is further driven to rotate, and a series of operations starting from charging is repeated again, to sequentially form images.

Since the image forming apparatus 21 according to the present invention has an electrophotographic photoreceptor having a photosensitive layer in which a triarylamine dimer compound represented by the general formula (1):

(1)

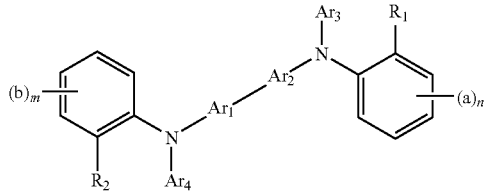

wherein $Ar_1$ and $Ar_2$ may be the same or different, and represent an unsubstituted or substituted arylene group or an unsubstituted or substituted heterocyclic derivative bivalent group, $Ar_3$ and $Ar_4$ may be the same or different, and represent an unsubstituted or substituted aryl group or an unsubstituted or substituted heterocyclic group, $R_1$ and $R_2$ may be the same or different, and represent an alkyl group, m and n represent an integer of 1 to 4, a and b may be the same of different, and represent a hydrogen atom, a halogen atom, an alkyl group, a fluoroalkyl group, an alkoxy group or an unsubstituted or substituted amino group, and when the m or n is 2 or more, and two of a or b are adjacent to each other, a methylenedioxy group, an ethylenedioxy group, a tetramethylene group or a butadienylene group is formed; is uniformly dispersed as a charge transporting material, it is possible to form an image with high quality with no image defects such as black points.

More specifically, according to the present invention, there are provided an electrophotographic photoreceptor having a photosensitive layer in which a triarylamine dimer compound represented by sub formula (2):

(2)

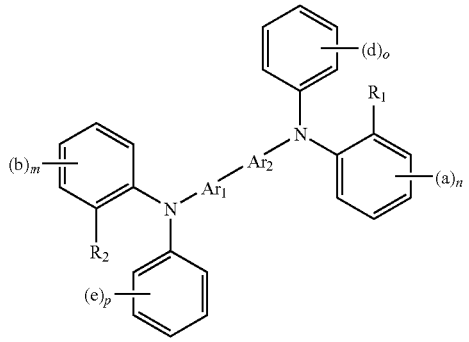

wherein $Ar_1$, $Ar_2$, $R_1$, $R_2$, m, n, a and b are the same as defined in the general formula (1), d and e have the same meanings with a and b in the general formula (1), and o and p are integers from 1 to 7; is uniformly dispersed, and an image forming apparatus having the same.

Further, according to the present invention, there are provided an electrophotographic photoreceptor having a photosensitive layer in which a triarylamine dimer compound represented by sub formula (3);

(3)

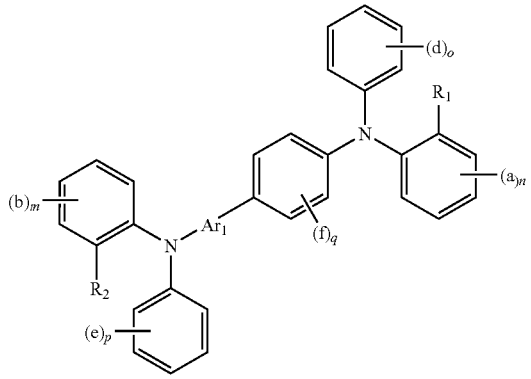

wherein $Ar_1$, $R_1$, $R_2$, a and b are the same as defined in the general formula (1), d, e, o and p are the same as defined in sub formula (2), and f and q have the same meanings as a and n in the general formula (1);

is uniformly dispersed, and an image forming apparatus having the same.

Also according to the present invention, there are provided an electrophotographic photoreceptor having a photosensitive layer in which a triaiylamine dimer compound represented by structural formula (I):

(I)

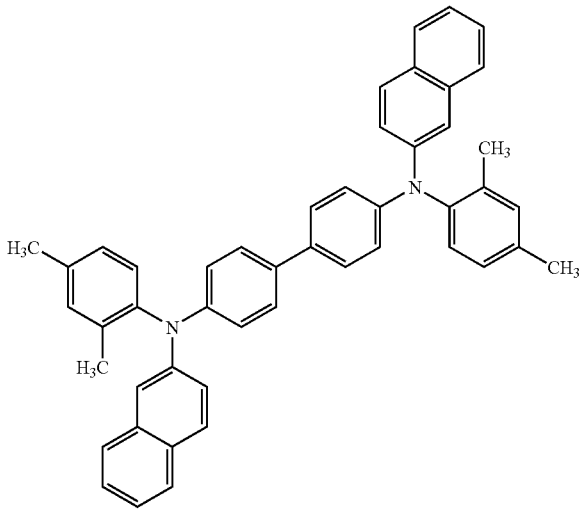

is uniformly dispersed, and an image forming apparatus having the same.

Process Cartridge

Figure 3B:
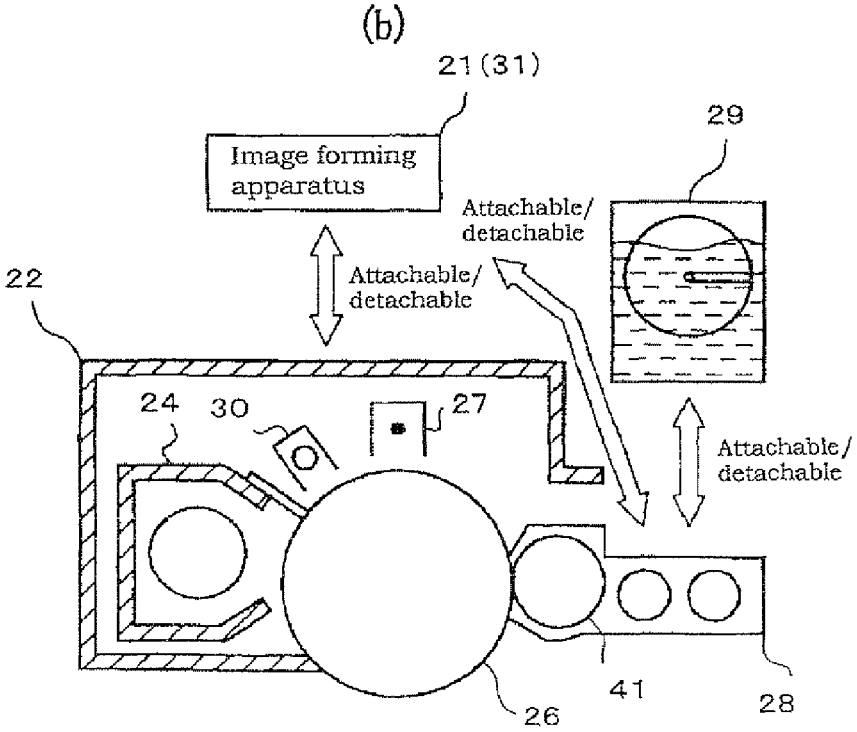
FIG. 3B is a schematic view of a process cartridge according to an embodiment of the present invention.

Overall processes of a general electrophotographic process used in an image forming apparatus such as copying machine, facsimile machine or printer typically include the steps of charging, light exposure, development, transfer, cleaning, fixing and electricity removal as shown in FIGS. 3A and 3B.

To be more specific, the photoreceptor drum 26 which is a core of electrophotographic process is disposed in the image forming apparatus 21 so as to be rotatable in the direction of the arrow S1, and a surface of the photoreceptor drum 26 bears an electrostatic latent image by uniformly charging at a predetermined charge amount by a corona charger (illustrated) having a high-voltage power supply (not shown) or a contact roller charging unit (not shown) which is the charging unit 27, and forming a predetermined electrostatic latent image potential by the light-exposing means 23.

The photoreceptor drum 26 includes the conductive base 11 made of metal or resin, the optional undercoat layer 15 formed thereon, and the photosensitive layer 14 formed thereon. The photosensitive layer 14 is made up of the relatively thin charge generating layer 12 formed on the optional undercoat layer 15, and the relatively thin charge transporting layer 13 formed in the outermost layer.

Carriers (charges) generate in the charge generating layer 12 by light exposure, and charges on the photoreceptor drum 26 are cancelled by the carries, so that the electrostatic latent image potential is formed. The electrostatic latent image borne on the photoreceptor drum 6 is conveyed to a developing region where it comes into contact with the developing agent carrier 41 of the developing unit 28 by rotation of the drum 26.

The developing agent carrier 41 rotates in the direction of an arrow S3 which is opposite to the arrow S1, and is pressed against the photoreceptor drum 26. Then, the toner carried on the developing agent carrier 41 inside the developing unit 28 moves together and adheres to the electrostatic latent image on the photoreceptor drum 26, so that the electrostatic latent image is visualized and developed.

A predetermined bias voltage is applied on the developing agent carrier 41 from a connected power supply (not shown). After development, the toner adhering to the photoreceptor drum 26 is conveyed to a predetermined transferring area. In the transferring area, the transfer paper 42 such as paper is supplied by a paper supplying means, which contacts on the photoreceptor drum 26 in synchronization with the toner image.

The transferring unit 24 provided in the transferring area may be a charger type having a high-voltage power supply (not shown) or a contact roller type (not shown), and applies voltage of the polarity of the side where the toner is transferred (the polarity opposite to that of the toner), to the photoreceptor drum 26. As a result, the toner moves to the transferring material, and a toner image is developed.

Since the transfer paper 42 and the photoreceptor drum 26 closely adhere to each other electro-statically by charges given by the transferring charger, it is necessary to peel the transferring material off the photoreceptor drum 26 so as to guide it to the fixing unit 25. As such a peeling device, a charger type having a high-voltage power supply, a peeling device by means of curvature of the photoreceptor drum 26, and a peeling device using a peeling claw can be recited, although illustration thereof is omitted.

In the case of a charger type peeling device, when an AC voltage is applied to the transfer paper 42 by the peeling device to reduce the potential of the transfer paper 42 to the same potential as the surface potential of the photoreceptor drum 26, attraction no longer effects between the transfer paper 42 and the photoreceptor drum 26, so that the transfer paper 42 is removed from the photoreceptor drum 26 by its own weight.

After the transfer paper 42 is removed from the photoreceptor drum 26, the toner on the transfer paper is fixed by the pressurizing roller 32 and the heating roller 33 of the fixing unit 25. For example, the toner is fixed onto the transfer paper 42 by heat fusion, and the paper is discharged outside the apparatus. The surface of the photoreceptor drum 26 after transferring is cleaned by the cleaner 34, and charges remaining on the surface are removed by a discharging unit 30. This achieves electric initialization. As the discharging unit 30, an optical electricity removing lamp, or a contact discharging unit is applied.

The foregoing operations of the parts involved in an electrophotographic process of the image forming apparatus 21 are controlled by a control unit (not shown) disposed in the main body of image forming apparatus 31. The control unit is made up of, for example, a ROM storing a micro computer and a control program executed by the micro computer, a RAM providing work area for data processing, an input circuit into which a signal is inputted from a sensor or a switch provided inside the image forming apparatus 21, and an output circuit for outputting a control signal to a motor or an actuator disposed inside the image forming apparatus 21. Furthermore, the main control unit has a nonvolatile memory for holding an identification number of the attached toner supply container. The microcomputer recognizes the state of each sensor and each switch, and a control signal to each motor and each actuator is sent via an output circuit.

Figure 4:
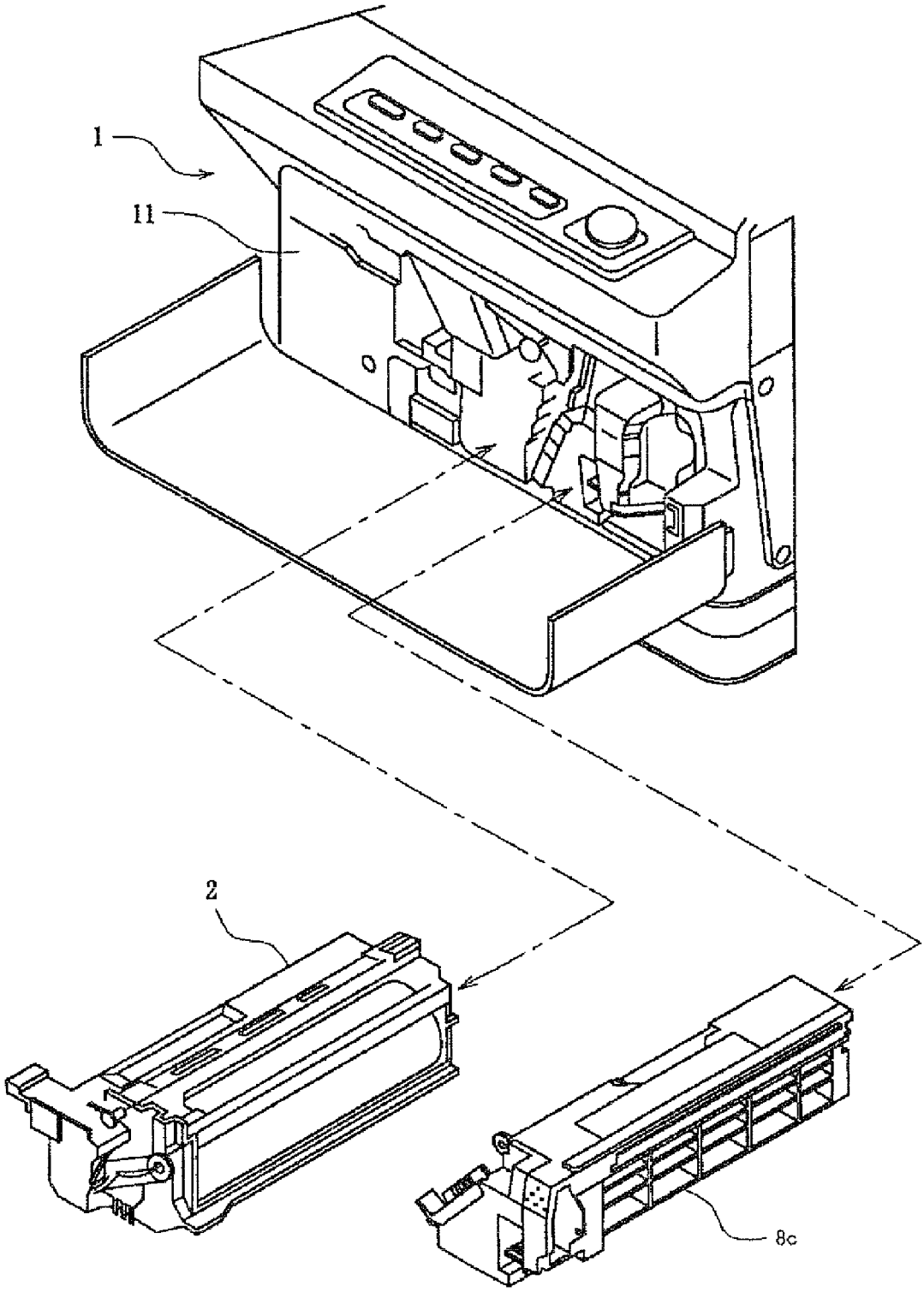
FIG. 4 is a schematic view of attachment/detachment of the image forming apparatus and the process cartridge according to an embodiment of the present invention.

By the way, in the electrophotographic process apparatus as described above, a measure of combining several devices in a single cartridge is widely taken to facilitate the maintenance as shown in FIGS. 3B and 4.

In one exemplary form, a toner bottle provided in correspondence with the developing unit 28 accommodating a predetermined developing agent, for accommodating toner to be supplied to the developing unit 28 is realized by a cartridge to form a toner supply container 29 and is made attachable/detachable to/from the main body 21. There is also a form of a developing cartridge 28*c* in which the toner supply container 29 and the developing unit 28 are designed to be integrally attachable/detachable to/from the main body of image forming apparatus 31. There is also a form of a process cartridge 22 in which in addition to, or separately from the developing unit 28 and the toner supply container 29, at least one of process means such as the charging unit 27 and the cleaner 34 operating on the photoreceptor drum 26 and the photoreceptor drum 26 is integrated, and made attachable/detachable to/from the main body of image forming apparatus 31.

A concrete manner of attachment of the toner supply containers for the image forming apparatus such as the process cartridge 22 and the developing cartridge 28*c* to the main body of the image forming apparatus 31 is shown in FIG. 4. FIG. 4 is a form in which the process cartridge 22 and the developing cartridge 28*c* are configured as separate cartridges.

When the process cartridge 22 includes the developing unit 28 and the toner supply container 29, replacement is facilitated but the photoreceptor drum 26 and the toner supply container 29 whose life times are not necessarily the same should be disposed at once. From this viewpoint, it is reasonable to form the process cartridge 22 including the photoreceptor drum 26, and the developing cartridge 28*c* including the toner supply container 29 or the toner supply container by separate cartridges in order to use the toner supply container 29 efficiently.

When the process cartridge 22 and the developing cartridge 28*c* are separate from each other as described above, it is preferred to reduce the size of the toner supply container 29 so as to downsize the apparatus. In this case, the process cartridge 22 has a longer life time than the developing cartridge

28*c* including the toner supply container 29 or the toner supply container. In other words, after the developing cartridge 28*c* including the toner supply container 29 or the toner supply container is replaced several times, the photoreceptor drum cartridge is replaced.

In an appropriate position such as longitudinal opposite side (back side) in the part that is visible when the developing cartridge including the toner supply container or the toner supply container is attached to the image forming apparatus as shown in FIG. 4, a nonvolatile memory device that stores information about a use amount of the toner supply container or the like is mounted to enable display of the remaining amount of toner as needed.

Therefore, according to the present invention, there is provided a process cartridge which integrally supports at least one means selected from the group consisting of an electrophotographic photoreceptor containing the triarylamine dimer as a charge transporting material, a charging means, a developing means and a cleaning means, and is attachable/detachable to/from a main body of an electrophotographic apparatus.

Therefore, according to the present invention, it is possible to provide a reliable image forming apparatus capable of forming an image with high quality in various environments. Further, since performance of the photoreceptor of the present invention will not be deteriorated by light exposure, deterioration in image quality by light exposure of the photoreceptor at the time of maintenance can be prevented, and the reliability of the image forming apparatus can be improved.

EXAMPLES

In the following, the present invention will be concretely explained by way of Production Examples, Examples and Comparative Examples, however, the present invention will not be limited by these Production Examples and Examples.

In addition, chemical structures, molecular weights and elemental analyses of compounds obtained in Production Examples were measured with the following apparatuses in the following conditions.

(Chemical Structure)

Nuclear magnetic resonator: NMR (Type: DPX-200 available from Bruker BIOSPIN)

Sample adjustment about 4 mg sample/0.4 m ($CDCl_3$)

Measurement mode $^1H$ (normal), $^{13}C$ (normal, DPET-135)

(Molecular weight)
Molecular weight measurer: LC-MS (Finegan LCQ Deca mass spectrometer system available from ThermoQuest)

| | |
|---|---|
| LC column | GL-Sciences Inertsil ODS-3 2.1 × 100 mm |
| Column temperature | 40° C. |
| Eluent | methanol:water = 90:10 |
| Sample injection amount | 5 μL |
| Detector | UV 254 nm and MS ESI |

(Elemental Analysis)

Elemental analyzer: Elemental Analysis 2400 available from Perkin Elmer

Sample amount: about 2 mg was finely weighed

Gas flow rate (mL/min.): He=1.5, $O_2$=1.1, $N_2$=4.3

Combustion tube temperature setting: 925° C.

Reduction rube temperature setting: 640° C.

Elemental analysis was conducted by carbon (C), hydrogen (H) and nitrogen (N) simultaneous quantification by differential thermal conductivity method.

Production Example 1

Synthesis of Triarylamine Dimer Compound

Exemplary Compound No. 1

In 100 mL of o-dichlorobenzene, 4.75 g (2.0 equivalents) of 2,4-xylyl-β-naphthylamine, 2.98 g (1.0 equivalent) of 4,4'-dibromobiphenyl, 1.02 g (0.2 equivalent) of 18-crown-6-ether, 4.9 g (4.0 equivalents) of copper powder, and 21.3 g (8.0 equivalents) of anhydrous potassium carbonate were mixed, the reaction temperature was raised to 180° C., and reaction was allowed for 18 hours under stirring and reflux while the temperature was kept by heating. After end of the reaction, sellite filtration was conducted while the reaction was still hot, and the filtrate was concentrated, and the residue was purified by silica gel column chromatography, to obtain 4.95 g of white powder compound.

A chemical structure and elements of the obtained white powder compound were analyzed.

Nuclear magnetic resonator: NMR

In $^1H$-NMR (normal), spectrum was observed at δ=2.06 (S, 6H), 2.38 (S, 6H), 6.97 to 7.82 (m, 28H).

In $^{13}C$-NMR (normal, DEPT-135), spectrum was observed at δ=18.66 (CH3, 4C), 21.76 (CH3, 4C), 117.00 (CH, 2C), 121.96 (CH, 4C), 122.72 (CH, 2C), 124.00 (CH, 2C), 126.35 (CH, 2C), 126.87 (CH, 2C), 127.21 (CH, 4C), 127.66 (CH, 2C), 128.31 (CH, 2C), 128.78 (CH, 2C), 129.48 (C, 2C), 129.59 (CH, 2C), 132.60 (CH, 2C), 133.95 (C, 2C), 134.64 (C, 2C), 136.06 (C, 2C), 136.33 (C, 2C), 142.77 (C, 2C), 145.26 (C, 2C), 146.46 (C, 2C).

Figure 5:
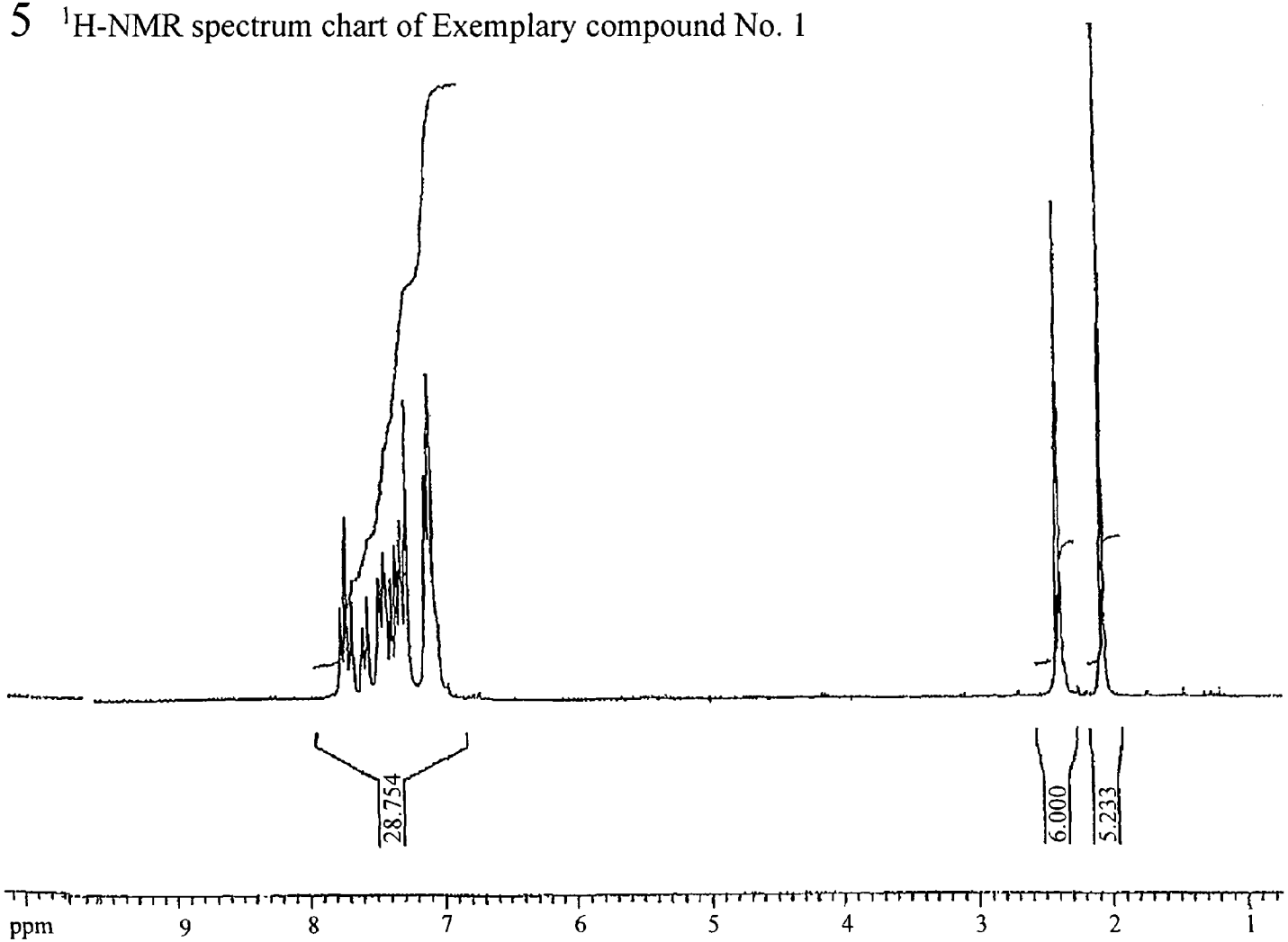
FIG. 5 is a $^{1}$H-NMR spectrum chart of Exemplary compound No. 1 according to an embodiment of the present invention.
Figure 6:
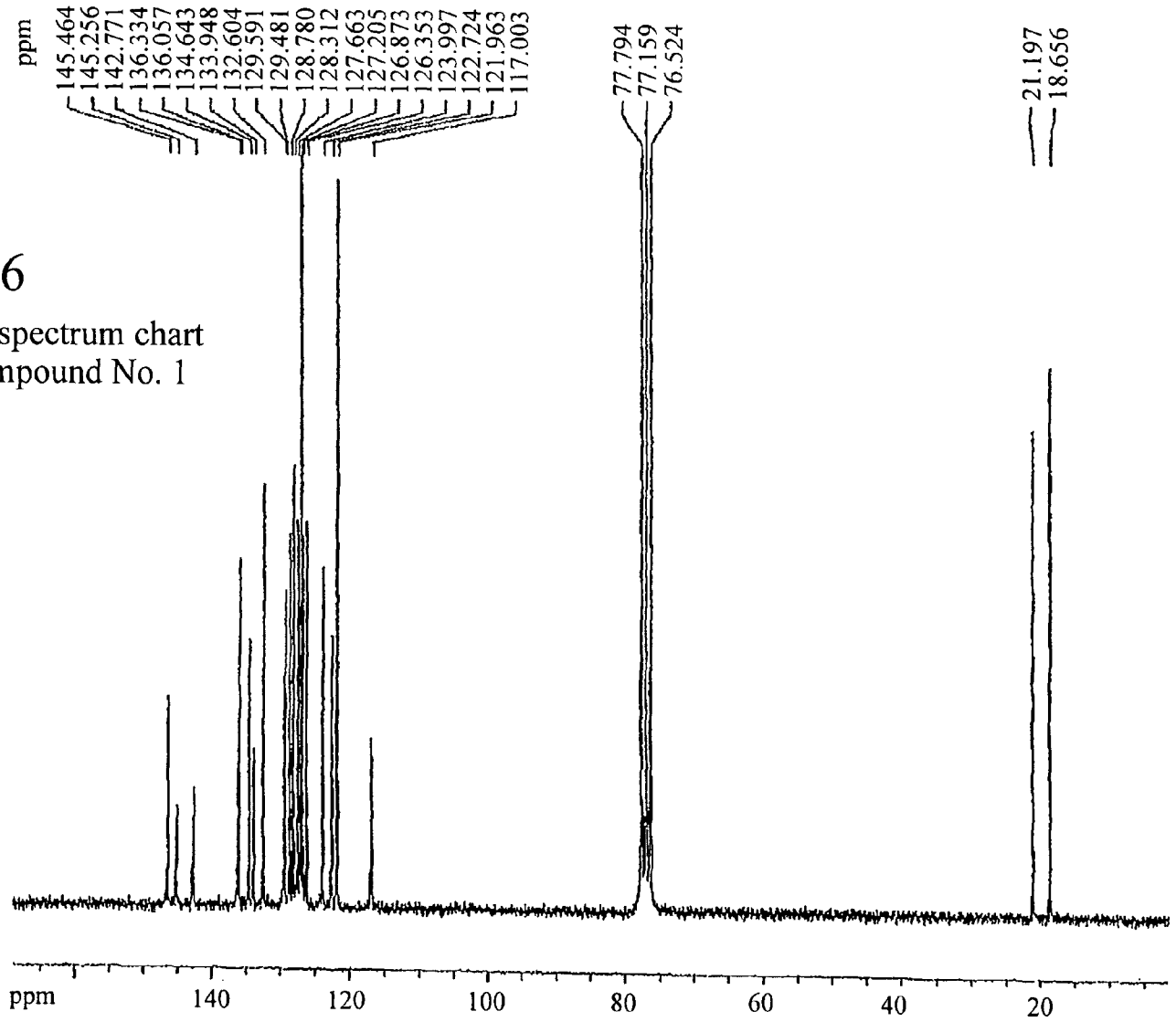
FIG. 6 is a $^{13}$C-NMR spectrum chart of Exemplary compound No. 1 according to an embodiment of the present invention.
Figure 7:
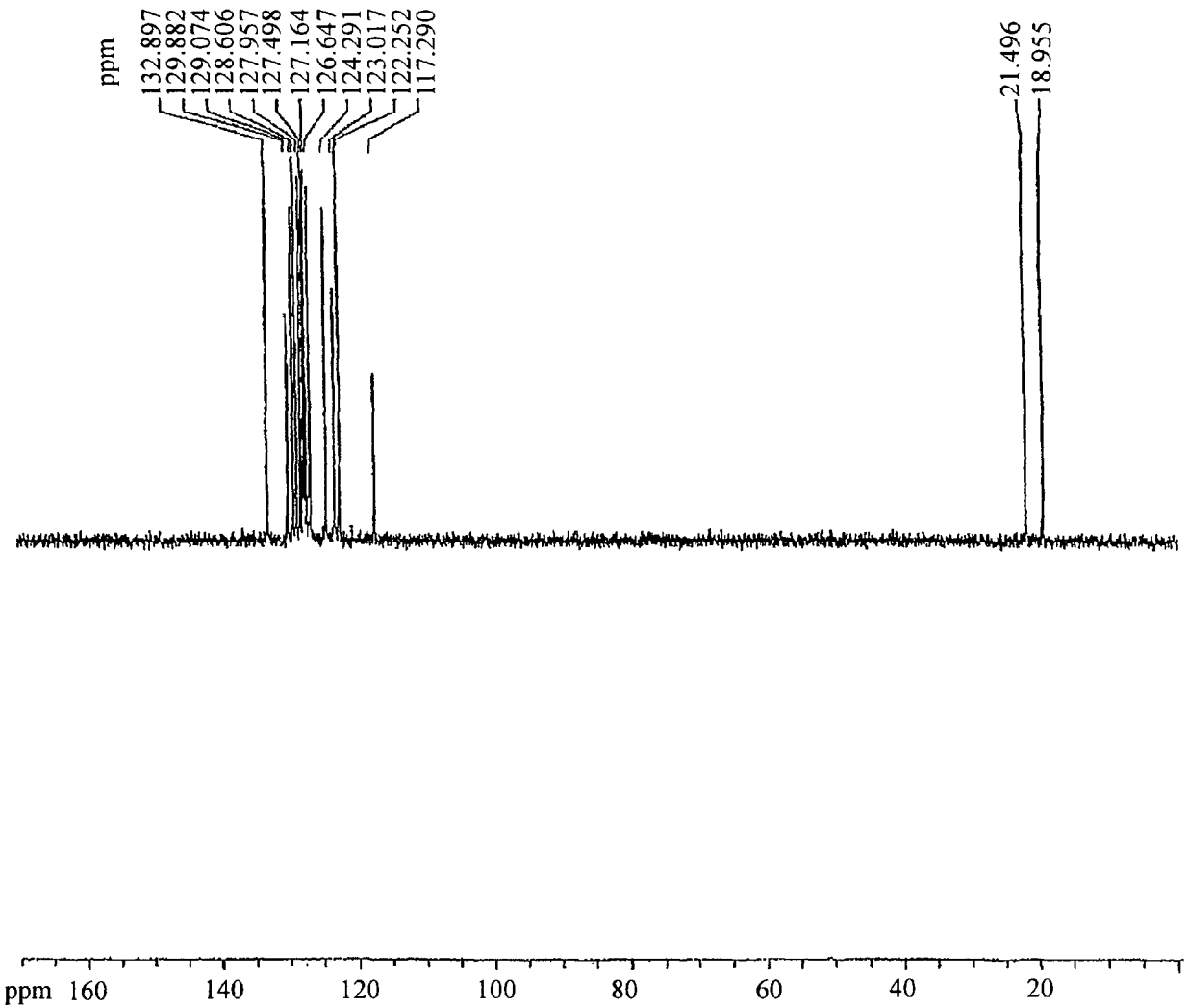
FIG. 7 is a DEPT 135 $^{13}$C-NMR spectrum chart of Exemplary compound No. 1 according to an embodiment of the present invention.

FIGS. 5 to 7 are a $^1H$-NMR spectrum chart, a normal $^{13}C$-NMR spectrum chart, and a $^{13}C$-NMR spectrum chart of DEPT-135, respectively.

Signals observed in the above various NMR measurements well support the structure of Exemplary compound No. 1 which is an objective triarylamine dimer compound.

In the molecular weight measuring apparatus: LC-MS, a peak was observed at 645.5 corresponding to a molecular ion $[M+H]^+$ which is the Exemplary compound No. 1 (calculated molecular weight: 644.32) added with a proton.

Elemental analysis values of the white powder compound were as follows.

<Elemental analysis values of Exemplary compound No. 1>

| | |
|---|---|
| Theoretical values | C: 89.40%, H: 6.25%, N: 4.34% |
| Measured values | C: 89.04%, H: 5.97%, N: 4.01% |

Analytical results of NMR, LC-MS and elemental analysis revealed that the obtained white powder compound was a triarylamine dimer compound of Exemplary compound No. 1 (yield: 80.1%). Further, analytical results of HPLC at measurement of LC-MS revealed that the purity of the Exemplary compound (I) was 99.0%.

Production Examples 2 to 5

Synthesis of Exemplary Compounds No. 3, 7, 13 and 20

In Production Example 1, completely the same operation was conducted using material compounds shown in Table 2 as a bisaryl dihalogen compound derivative represented by the general formula (4) and a secondary amine compound represented by the general formula (5), to produce Exemplary compounds No. 3, 7, 13 and 20, respectively. In the Table 2 below, material compounds of Exemplary compound No. 1 are also shown together.

Elemental analysis values, a calculated value and a measured value by LC-MS [M+H] of a molecular weight of each Exemplary compound obtained in the above Production Examples 1 to 5 are shown in Table 3.

TABLE 2

| Compound | Dihalogen compound General formula (4) | Amine compound General formulae (5) and (6) | |
|---|---|---|---|
| Production Example 1 Exemplary compound No. 1 | 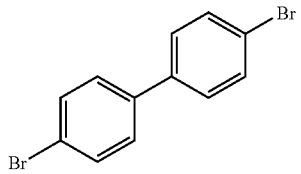 | 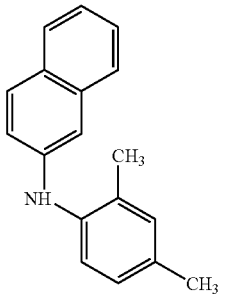 | 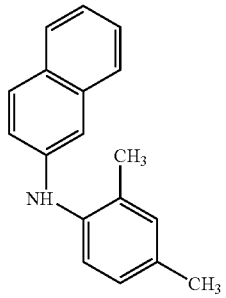 |
| Production Example 2 Exemplary compound No. 3 | 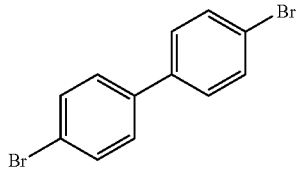 | 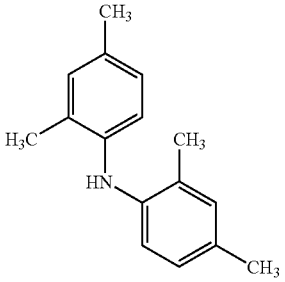 | 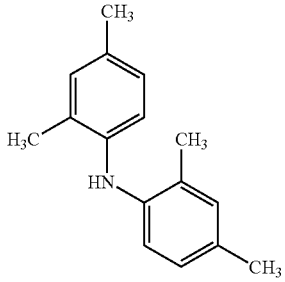 |
| Production Example 3 Exemplary compound No. 7 | 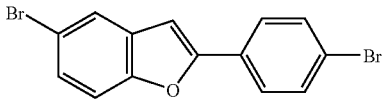 | 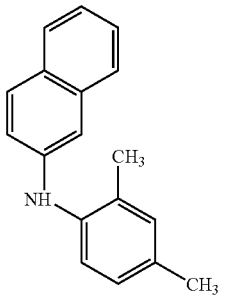 | 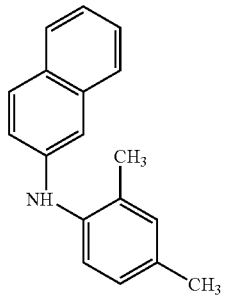 |
| Production Example 4 Exemplary compound No. 13 | 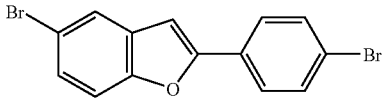 | 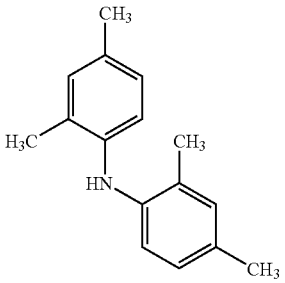 | 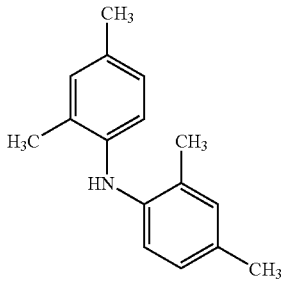 |
| Production Example 5 Exemplary compound No. 20 | 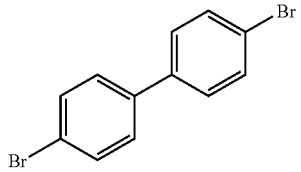 | 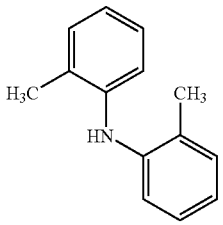 | 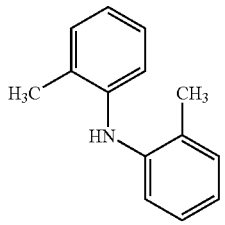 |

TABLE 3

| Compound | Structural formula | Elemental analysis C (%) H (%) N (%) | LC-MS |
|---|---|---|---|
| Production Example 1 Exemplary compound No. 1 | 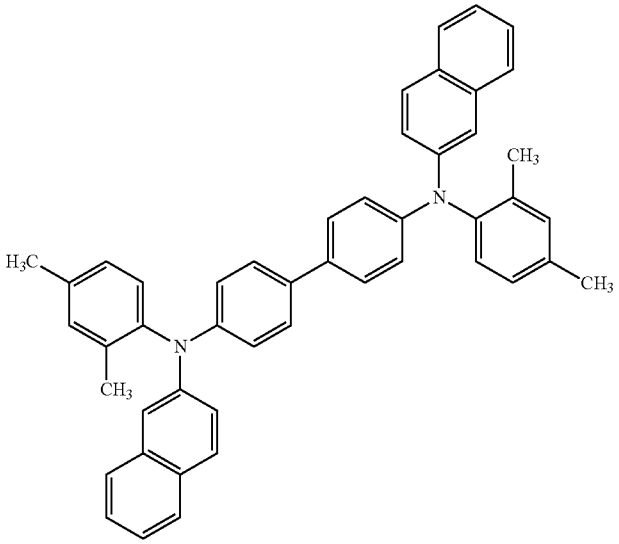 | Theoretical value 89.4 6.25 4.34 Observed 89.04 5.97 4.01 | Calculated value 644.32 Observed $[M + H]^+$ 645.3 |
| Production Example 2 Exemplary compound No. 3 | 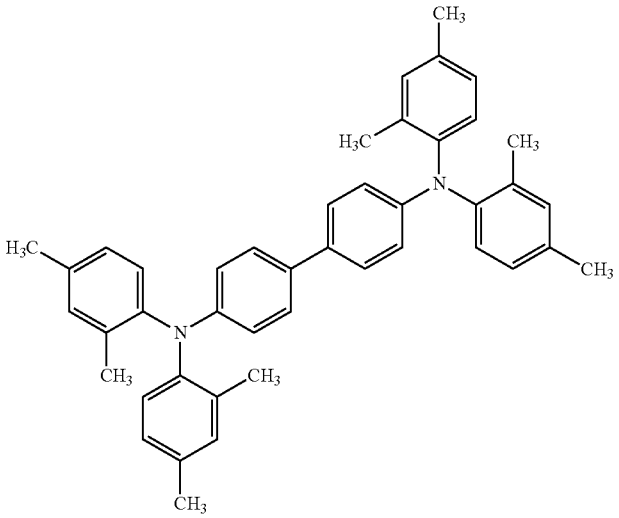 | Theoretical value 87.96 7.38 4.66 Observed 87.59 7.04 4.41 | Calculated value 600.35 Observed $[M + H]^+$ 601.5 |
| Production Example 3 Exemplary compound No. 7 | 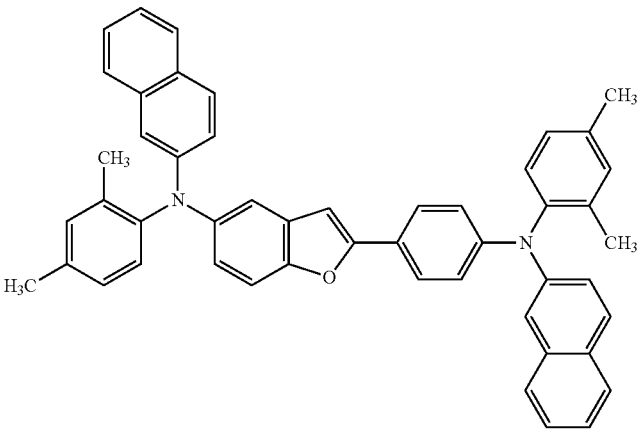 | Theoretical value 87.69 5.89 4.09 Observed 87.24 8.64 3.78 | Calculated value 984.31 Observed $[M + H]^+$ 985.7 |

TABLE 3-continued

| Compound | Structural formula | Elemental analysis C (%) H (%) N (%) | LC-MS |
|---|---|---|---|
| Production Example 4 Exemplary compound No. 13 | 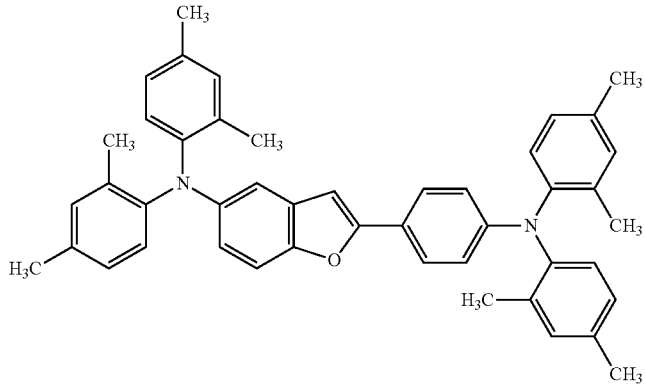 | Theoretical value 86.21 6.92 4.37 Observed 85.94 6.65 3.98 | Calculated value 640.35 Observed $[M + H]^+$ 641.6 |
| Production Example 5 Exemplary compound No. 20 | 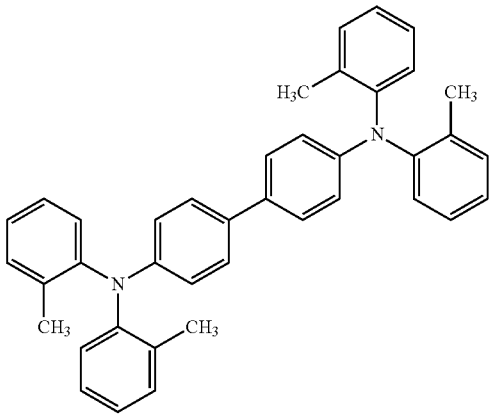 | Theoretical value 88.2 6.66 5.14 Observed 87.92 6.41 4.87 | Calculated value 544.28 Observed $[M + H]^+$ 545.6 |

Examples 1

An electrophotographic photoreceptor using Exemplary compound No. 1 which is a triarylamine dimer compound according to the present invention produced in Production Example 1, as a charge transporting material of a charge transporting layer was produced in the following manner.

As a conductive supporting member, an aluminum tube of 1 mm thick, 30 mm in diameter, and 340 mm long was used. 7 parts by weight of titanium oxide (trade name: TI PAQUE TTO55A, available from ISHIHARA SANGYO KAISYA LTD.) and 13 parts by weight of a copolymeric nylon resin (trade name: AMILAN CM8000, available from TORAY INDUSTRIES, INC.) were added to a mixed solvent of 159 parts by weight of methyl alcohol and 106 parts by weight of 1,3-dioxolane, and dispersed for 8 hours with a paint shaker, to prepare 10 kg of a coating solution for undercoat layer (intermediate layer) formation. This coating solution for intermediate layer formation was applied on the aluminum tube which is a conductive supporting member by a dip coating method, and dried naturally, to form an intermediate layer having a film thickness of 1 μm.

Next, 1 part by weight of X-type non-metallic phthalocyanine (Fastogen Blue 8120, available from DIC Corporation) and 1 part by weight of butyral resin (trade name: #6000-C, available from DENKI KAGAKU KOGYO KABUSHIKI KAISYA) were mixed with 98 parts by weight of methylethyl ketone, and dispersed with a paint shaker, to prepare 10 Kg of a coating solution for charge generating layer formation. This coating solution for charge generating layer formation was applied to a surface of the previously formed intermediate layer in a similar way as in the case of the above intermediate layer by a dip coating method, and naturally dried to form a charge generating layer having a film thickness of 0.4 μm.

Next, 8 parts by mass of compound of Exemplary compound No. 1 produced in Production Example 1 and 10 parts by mass of polycarbonate resin (C-1400 available from TEIJIN CHEMICALS LTD.) were dissolved in 80 parts by mass of THF, to prepare 10 Kg of a coating solution for charge transporting layer formation. This coating solution for charge transporting layer formation was applied onto the previously formed charge generating layer by a similar dip coating method, and dried for 1 hour in a thermostatic bath at 80° C., to form a charge transporting layer having a film thickness of 15 μm. In the manner as described above, the layered-type electrophotographic photoreceptor shown in FIG. 1 was fabricated.

Example 2

An electrophotographic photoreceptor was produced in a similar manner as in Example 1 except that a compound of Exemplary compound No. 3 shown in the above Table 3 was used as a charge transporting material in place of Exemplary compound No. 1.

Examples 3 to 5

Three kinds of electrophotographic photoreceptors were fabricated in a similar manner as in Example 1 except that compounds of Exemplary compounds No. 7, 13 and 20 shown in the above Table 3 were respectively used as a charge transporting material in place of Exemplary compound No. 1.

Examples 6 to 7

Two kinds of electrophotographic photoreceptors were fabricated in a similar manner as in Example 1 except that the film thickness of the charge transporting layer was 10 μm and 30 μm, respectively.

Comparative Example 1

An attempt was made to fabricate an electrophotographic photoreceptor in a similar manner as in Example 1 except that compound α-Np-TPD having a triarylamine structure (available from TOKYO CHEMICAL INDUSTRY CO., LTD.) was used as a charge transporting material in place of Exemplary compound No. 1. However, α-Np-TPD failed to be dissolved in the used system, and an electrophotographic photoreceptor was not obtained.

Comparative Example 2

An electrophotographic photoreceptor was fabricated in a similar manner as in Example 1 except that a compound having a triarylamine structure 4 mM-TPD (available from Takasago Industry Co.; Ltd.) was used as a charge transporting material in place of Exemplary compound No. 1.

Comparative Example 3

An electrophotographic photoreceptor was fabricated in a similar manner as in Example 1 except that a compound having a triarylamine structure 4 mM-TPD (available from Takasago Industry Co., Ltd.) was used as a charge transporting material in place of Exemplary compound No. 1, and a ratio M/B between weight M of the charge transporting material and weight B of the binder resin was 10/20.

Comparative Example 4

Three kinds of electrophotographic photoreceptors were fabricated in a similar manner as in Example 1 except that a film thickness of the charge transporting layer was 35 μm.

For each of the electrophotographic photoreceptors obtained in Examples 1 to 5 and Comparative Examples 1 to 3, printing resistance and electric characteristics were evaluated in the following manner.

<Evaluation of Printing Resistance>

Each fabricated electrophotographic photoreceptor was placed in a digital copying machine (AR-451S available from SHARP CORPORATION) operating at a process speed of 225 mm/sec wherein an image light-exposing optical source was replaced by a 405 nm semiconductor laser (image writing by polygon mirror). After forming images on 50,000 sheets of paper, a film thickness of the photosensitive layer d1 was measured, and a reduced amount of film was determined as a difference Δd (=d0−d1) between the measured value and the film thickness d0 of the photosensitive layer at the time of fabrication, and used as an index for evaluation of printing resistance.

<Evaluation of Electric Characteristics>

Each electrophotographic photoreceptor obtained in Examples 1 to 5 and Comparative Examples 1 to 3 was mounted on the electrophotographic process of the copying machine shown in FIG. 4, and a surface potential of a photoreceptor (charged potential) MO, and a surface potential of a photoreceptor after electricity removal (residual potential) VL were measured by using 405 nm semiconductor laser (image writing by polygon mirror) as an image light-exposing optical source, by providing a surface potential meter (Model 344 available from Trek Japan Corporation) in the developing part for observing a surface potential of a photoreceptor in the developing part, concretely charge property.

The results are shown in Table 4.

TABLE 4

| | CTL CTM | M/B | V0 [-V] | VL [-V] | Film reduction amount (μm) |
|---|---|---|---|---|---|
| Example 1 | Exemplary compound No. 1 | 10/18 | 649 | 145 | 2.1 |
| Example 2 | Exemplary compound No. 3 | 10/18 | 648 | 150 | 2.3 |
| Example 3 | Exemplary compound No. 7 | 10/18 | 648 | 156 | 1.8 |
| Example 4 | Exemplary compound No. 13 | 10/18 | 649 | 158 | 2 |
| Example 5 | Exemplary compound No. 20 | 10/18 | 651 | 148 | 2.5 |
| Comparative Example 1 | Compound (A) | 10/18 | CTM not dissolved | | |
| Comparative Example 2 | Compound (B) | 10/18 | 648 | 155 | 3.7 |
| Comparative Example 3 | Compound (B) | 10/20 | 648 | 172 | 3.3 |

As shown in the above Table 4, it was found that the photoreceptors of Examples 1 to 5 using the triarylamine dimer compound according to the present invention in a charge transporting layer exhibited excellent electric characteristics even when a 430 nm semiconductor laser was used as a writing optical source. Abrasion in evaluation of printing resistance was small, and it was found that the electrophotographic photoreceptor using the charge transporting material represented by Exemplary compound No. 7 according to the present invention exhibited the most excellent abrasion resistance.

It can be found that the photoreceptor of Comparative Example 2 exhibits excellent electric characteristics in initial stage, however, abrasion by long-term use is large, and mechanical durability is insufficient.

It is also found that the photoreceptor of Comparative Example 3 in which the proportion of the binder resin with respect to the charge transporting material is increased exhibits slight improvement in mechanical printing resistance, but the sensitivity is insufficient because of a reduced content of the charge transporting material in the photosensitive layer.

These demonstrated that in the photoreceptor employing the charge transporting material 4 mM-TPD shown in Comparative Example 2, film reduction is about 1.7 times larger than the photoreceptor using the triarylamine dimer compound of the present invention, so that it is necessary to increase the film thickness of the charge transporting layer to keep the long life time in actual use.

Next, a printed matter obtained by actual printing conducted while the electrophotographic photoreceptor fabricated in the above Example was attached to the image forming apparatus was evaluated according to the evaluation method described below.

<Evaluation of Image Quality>

Using a digital copying machine (AR-451S available from SHARP CORPORATION) operating at a process speed of 225 mm/sec, and adjusting an optical system so that an image light-exposing optical source was 405 nm, and a spot diameter of beam was 21 μm, a halftone image of 1200 dpi was printed while the initial charge potential of the photoreceptor was set at −600V, and the light-exposure amount was set so that a surface potential of the exposed photoreceptor was −60V. Isolate dots obtained therein were formed on the photoreceptor, and the dot reproducibility of the image was evaluated under an optical microscopy. Similar evaluation was made also in the system in which the image light-exposing optical source was conventionally used 780 nm and the optical system was adjusted so that the beam spot diameter was 42 μm.

<Evaluation Criteria>

A: Each dot is isolate and distinct, and thus a image quality level is high.

B: Isolation of each dot is insufficient, and the image quality level is slightly insufficient.

C: Isolation of each dot is apparently insufficient.

These evaluation results are shown in Table 5.

TABLE 5

| | | CTL Film thickness Example | | | |
|---|---|---|---|---|---|
| CTM | Light exposure wavelength | Example 6 10 μm | Example 1 15 μm | Example 7 30 μm | Comparative Example 4 35 μm |
| Exemplary compound No.1 | 405 | A | A | B | C |
| | 780 | B | C | C | C |

However, evaluation of image in Table 5 reveals that the larger the film thickness of the charge transporting layer, the smaller the effect of improving a resolution using a short wavelength laser is. This is because when the film thickness of the charge transporting layer is increased, a carrier (charge) transporting distance from the boundary between the charge generating layer and the charge transporting layer to the surface of the photoreceptor which is the charge generating site is longer, so that Coulomb repulsion occurs between carries, and a latent image spreads on the surface of the photoreceptor. Therefore, for further taking advantage of the merit of a reduced diameter of a spot using the short wavelength laser, it is structurally advantageous to make the charge transporting layer be a thin film of 30 μm or less. Therefore, it can be found that improvement in abrasion resistance of the photoreceptor is essential to improve an image quality level using the short wavelength laser.

From these results, it was found that when a semiconductor laser beam having a wavelength of 380 to 500 nm was used as writing light, images of excellent electric characteristics and a high resolution can be provided for a long term by the electrophotographic photoreceptor using the charge transporting material represented by the structural formula (1) according to the present invention.

According to the present invention, by using a triarylamine dimer compound represented by the general formula (1) having an o-methyl-phenyl substituent in the photosensitive layer, and it is possible to reduce a film thickness of the charge transporting layer without increasing content of the binder resin at sacrifice of the electric characteristics as is the case where a usual charge transporting material is used because excellent electric characteristics with respect to the blue (violet) semiconductor laser is obtained, and high printing resistance are provided. Hence, it is possible to provide a process cartridge and an electrophotographic apparatus capable of obtaining an output image with a high resolution over a long term.

What is claimed is:

1. An electrophotographic photoreceptor comprising a layered-type photosensitive layer in which a charge generating layer containing a charge generating material and a charge transporting layer containing a charge transporting material are stacked, formed on a conductive supporting member made of a conductive material, wherein the electrophotographic photoreceptor has high sensitive characteristics to a semiconductor laser beam having a wavelength ranging from 380 to 500 nm; the charge transporting layer of the layered-type photosensitive layer contains as the charge transporting material, a triarylamine dimer compound represented by the general formula (I):

(1)

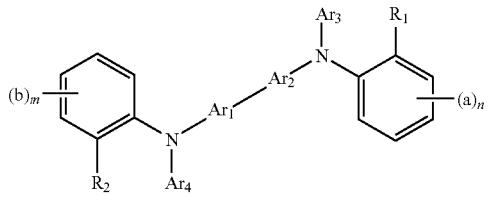

when $Ar_1$ and $Ar_2$ represent phenylene group, $Ar_3$ and $Ar_4$ represent 2 naphthyl group, $R_1$ and $R_2$ represent methyl group, a and b represent methyl group, and m and n represent 1;

when $Ar_1$ represents 2,5-benzofuranylidene group and $Ar_2$ represents phenylene group, $Ar_3$ and $Ar_4$ represent 2-naphthyl group, $R_1$ and $R_2$ represent methyl group, a and b represent methyl group, and m and n represent 1;

when $Ar_1$ represent 2,5-benzofuranylidene group and $Ar_2$ represents phenylene group, $Ar_3$ and $Ar_4$ represent 2,4-dimethylphenyl group, $R_1$ and $R_2$ represent methyl group, a and b represent methyl group, and m and n represent 1; or when $Ar_1$ and $Ar_2$ represent phenylene group, $Ar_3$ and $Ar_4$ represent o-tolyl group, $R_1$ and $R_2$ represent methyl group, a and b represent a hydrogen atom, and m and n represent 1;

and a film thickness of the photosensitive layer is 30 μm or less.

2. An electrophotographic photoreceptor comprising a layered-type photosensitive layer in which a charge generating layer containing a charge generating material and a charge transporting layer containing a charge transporting material are stacked, formed on a conductive supporting member made of a conductive material, wherein the electrophotographic photoreceptor has high sensitive characteristics to a semiconductor laser beam having a wavelength ranging from 380 to 500 nm; the charge transporting layer of the layered-type photosensitive layer contains as the charge transporting material, a triarylamine dimer represented by structural formula (I):

(I)

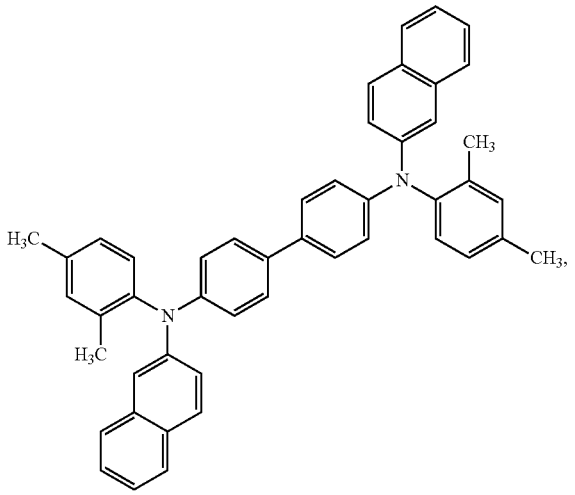

and a film thickness of the photosensitive layer is 30 μm or less.

3. The electrophotographic photoreceptor according to claim 1, wherein the charge transporting layer contains a binder resin, and a ratio (M/N) between a weight M of the charge transporting material and a weight of the binder resin is 10/8 to 10/30.

4. The electrophotographic photoreceptor according to claim 1, wherein the charge generating layer of the layered-type photosensitive layer contains an oxotitanium phthalocyanine in which a Bragg angle)(2θ±0.2°) in Cu-Kα characteristic X-ray diffraction (wavelength: 1.54 Å) has a diffraction peak at least at 27.2°, as the charge generating material.

5. The electrophotographic photoreceptor according to claim 1, further comprising an intermediate layer between the conductive supporting member and the layered-type photosensitive layer.

6. An image forming apparatus comprising: the electrophotographic photoreceptor according to claim 1; a charging means that charges the electrophotographic photoreceptor; a light-exposing means that executes light exposure to the charged electrophotographic photoreceptor with a semiconductor laser having a wavelength of 380 to 500 nm; and a developing means that develops an electrostatic latent image formed by light exposure.

7. A process cartridge supporting at least one means selected from the group consisting of the electrophotographic photoreceptor according to claim 1, a charging means, a developing means and a cleaning means in an integrated manner, the process cartridge being attachable/detachable to/from a main body of the electrophotographic apparatus.

* * * * *